US011505893B2

(12) United States Patent
Lai

(10) Patent No.: US 11,505,893 B2
(45) Date of Patent: Nov. 22, 2022

(54) GARMENT STEAMING DEVICE

(71) Applicant: CONAIR CORPORATION, Stamford, CT (US)

(72) Inventor: Kin Man Lai, New Territories (HK)

(73) Assignee: Conair LLC, Stamford, CT (US)

( * ) Notice: Subject to any disclaimer, the term of this patent is extended or adjusted under 35 U.S.C. 154(b) by 72 days.

(21) Appl. No.: 16/808,720

(22) Filed: Mar. 4, 2020

(65) Prior Publication Data

US 2021/0277590 A1 Sep. 9, 2021

(51) Int. Cl.
*D06F 73/00* (2006.01)
*D06F 87/00* (2006.01)

(52) U.S. Cl.
CPC ..... *D06F 73/00* (2013.01); *D06F 87/00* (2013.01)

(58) Field of Classification Search
CPC ..... D06F 73/00; D06F 73/02; D06F 87/00; D06F 75/08; D06F 75/26; D06F 75/28; D06F 75/36; D06F 75/38
See application file for complete search history.

(56) References Cited

U.S. PATENT DOCUMENTS 2,418,511 A * 4/1947 Hume ..... D06F 75/20 38/77.83
2,750,692 A * 6/1956 Finlayson ..... D06F 75/14 38/77.81
3,308,566 A * 3/1967 Jepson ..... H01H 9/0011 38/77.7
3,559,427 A 2/1971 Baker
3,599,357 A 8/1971 Gronwick et al.
3,690,024 A 9/1972 Osrow
4,274,588 A * 6/1981 Schwob ..... A45D 19/16 222/146.5
4,990,745 A 2/1991 Bayles et al.
5,042,179 A 8/1991 Van Der Meer
5,146,700 A * 9/1992 Prosser ..... D06F 75/38 38/77.9
5,279,054 A 1/1994 Chasen
(Continued)

FOREIGN PATENT DOCUMENTS

CN 202157222 3/2012
CN 106480694 A 3/2017
(Continued)

OTHER PUBLICATIONS

Corresponding PCT Application No. PCT/US20/67411 International Search Report and Written Opinion dated Apr. 12, 2021.

*Primary Examiner* — Ismael Izaguirre
(74) *Attorney, Agent, or Firm* — Grogan, Tuccillo & Vanderleeden, LLP

(57) ABSTRACT

A garment steaming device includes a housing having a reservoir for containing liquid therein, a head portion connected to the housing, and a steam generator contained within the head portion, the steam generator being in fluid communication with the reservoir for generating steam from the liquid contained in the reservoir. The steam generator includes a first layer and a second layer and at least one heating element sandwiched between the first layer and the second layer. The first layer and the second layer define a steam flowpath that is configured such that steam flows back and forth between the first layer and the second layer before exiting the steam generator.

19 Claims, 37 Drawing Sheets

(56) References Cited

U.S. PATENT DOCUMENTS

| | | | | |
|---|---|---|---|---|
| 5,279,055 | A * | 1/1994 | Eckert | D06F 75/18 219/254 |
| 5,297,054 | A | 3/1994 | Kienzle et al. | |
| 5,642,579 | A | 7/1997 | Netten et al. | |
| 5,651,201 | A * | 7/1997 | Farley | D06F 75/30 219/255 |
| 5,704,143 | A | 1/1998 | Kubicz | |
| 5,721,418 | A | 2/1998 | Hazan et al. | |
| 5,743,034 | A * | 4/1998 | Debourg | C02F 5/025 38/77.8 |
| 6,079,133 | A | 6/2000 | Netten | |
| 6,167,643 | B1 | 1/2001 | Dodier et al. | |
| 6,314,668 | B1 * | 11/2001 | Daulasim | A47J 31/605 38/77.8 |
| 6,438,876 | B2 | 8/2002 | Har et al. | |
| D481,183 | S | 10/2003 | Mangano | |
| 6,802,141 | B2 | 10/2004 | Walther | |
| 6,986,217 | B2 | 1/2006 | Leung et al. | |
| 7,096,612 | B2 | 8/2006 | Lesaga | |
| 7,155,117 | B2 | 12/2006 | Leung et al. | |
| 7,389,597 | B1 | 6/2008 | Chen | |
| D576,363 | S | 9/2008 | Reiner | |
| 8,230,824 | B2 * | 7/2012 | Yao | A61H 33/12 122/379 |
| 8,365,447 | B2 | 2/2013 | Rosenzweig et al. | |
| 8,464,445 | B2 | 6/2013 | Jiang et al. | |
| 8,522,463 | B2 | 9/2013 | Ong et al. | |
| 9,567,705 | B2 | 2/2017 | Chua et al. | |
| 9,598,813 | B2 | 3/2017 | Mohankuma et al. | |
| 9,845,568 | B2 | 12/2017 | Fung | |
| D826,492 | S | 8/2018 | Huang et al. | |
| D848,093 | S | 5/2019 | Buckley et al. | |
| 10,309,053 | B2 * | 6/2019 | Yagi | D06F 75/18 |
| 2005/0150261 | A1 | 7/2005 | Carlucci | |
| 2006/0018638 | A1 | 1/2006 | Leung | |
| 2006/0188239 | A1 | 8/2006 | Carlucci | |
| 2008/0034813 | A1 | 2/2008 | Tobias | |
| 2008/0092932 | A1 | 4/2008 | Tam | |
| 2010/0086287 | A1 | 4/2010 | Rosenzweig et al. | |
| 2014/0298693 | A1 | 10/2014 | Tack | |
| 2017/0114495 | A1 | 4/2017 | Date et al. | |
| 2017/0260685 | A1 | 9/2017 | Fung | |
| 2018/0340291 | A1 | 11/2018 | Kim et al. | |
| 2018/0371684 | A1 | 12/2018 | Ong et al. | |
| 2019/0234006 | A1 | 8/2019 | Yan et al. | |
| 2019/0316289 | A1 | 10/2019 | Cordier et al. | |

FOREIGN PATENT DOCUMENTS

| | | | |
|---|---|---|---|
| CN | 207277038 | U | 4/2018 |
| CN | 109576967 | A | 4/2019 |
| CN | 209836625 | U | 12/2019 |
| EP | 3194648 | | 7/2017 |
| EP | 3246459 | | 11/2017 |
| EP | 3467193 | A1 | 4/2019 |
| FR | 2709138 | | 2/1995 |
| GB | 2438619 | | 12/2007 |
| WO | WO 2018/167609 | A1 * | 9/2018 |

* cited by examiner

GARMENT STEAMING DEVICE

FIELD OF THE INVENTION

The present invention relates generally to devices for the care of garments and other fabric items and, more particularly, to a garment steaming device and method of operating a garment steaming device.

BACKGROUND OF THE INVENTION

Portable hand held devices for applying steam are particularly useful in removing wrinkles and improving the appearance of hanging garments, draperies, upholstery, and other items made of fabric. When traveling, these devices may be especially effective for freshening clothes that have been packed in luggage. They are also useful for improving the appearance of hanging draperies without removing them, straightening and flattening upholstery, opening seams, and, generally, for smoothing fabric during sewing operations. In all of these applications, it is not only important to apply steam to the fabric, but to do so in a safe and easy manner. It is also important to be able to apply a desired amount of steam to a particular portion of the fabric being treated. One garment steamer is disclosed in U.S. Pat. No. 7,155,117 to Leung et al., the entire contents of which are incorporated by reference herein.

While existing garment steaming devices are generally suitable for what may be regarded as ordinary performance, there is room for improvement with respect to ease of use, ergonomics, steam generating capability and responsiveness. For example, existing garment steaming devices often take a long time to heat to temperature sufficient to generate steam. In addition, the steam pressure generated by existing devices may be less than optimal.

In view of the above, there is a need for a garment steaming device, and a method of operating a garment steaming device, that improve upon the devices currently known in the art.

SUMMARY OF THE INVENTION

It is an object of the present invention to provide a garment steaming device.

It is another object of the present invention to provide a garment steaming device that has a rapid response time upon start-up.

It is another object of the present invention to provide a garment steaming device that minimizes dripping upon start-up.

It is another object of the present invention to provide a garment steaming device capable of generating steam at high pressure.

It is another object of the present invention to provide a garment steaming device that distributes steam over a large surface area.

It is another object of the present invention to provide a garment steaming device that is ergonomic.

These and other objects are achieved by the present invention.

According to an embodiment of the invention, a garment steaming device includes a housing having a reservoir for containing liquid therein, a head portion connected to the housing, and a steam generator contained within the head portion, the steam generator being in fluid communication with the reservoir for generating steam from the liquid contained in the reservoir. The steam generator includes a first layer and a second layer and at least one heating element sandwiched between the first layer and the second layer. The first layer and the second layer define a steam flowpath that is configured such that steam flows back and forth between the first layer and the second layer before exiting the steam generator.

According to another embodiment of the present invention, a garment steaming device includes a housing having a reservoir for containing liquid therein, a head portion connected to the housing, a steam generator contained within the head portion, the steam generator being in fluid communication with the reservoir for generating steam from the liquid contained in the reservoir, a soleplate connected to the head portion, the soleplate having a plurality of outlets for distributing steam generated by the steam generator, and a cover having a plurality of apertures configured to distribute the steam to a layer between the cover and the soleplate. At least some of the outlets in the soleplate area aligned with at least some of the apertures in the cover to output direct, high-pressure steam, and at least some other of the outlets in the soleplate are offset from the apertures in the cover to output steam at a lower pressure than the high-pressure steam.

According to another embodiment of the present invention, a garment steaming device includes a housing having a reservoir for containing liquid therein, a head portion pivotably connected to the housing, and a steam generator contained within the head portion, the steam generator being in fluid communication with the reservoir for generating steam from the liquid contained in the reservoir.

According to another embodiment of the present invention, a garment steaming device includes a housing having a reservoir for containing liquid therein, a head portion connected to the housing, a steam generator contained within the head portion, the steam generator including a primary heating element and a secondary heating element, the steam generator being in fluid communication with the reservoir for generating steam from the liquid contained in the reservoir, and a control unit configured to regulate a steam temperature generated by the steam generator by controlling a power level of the primary heating element and the secondary heating element.

According to yet another embodiment of the present invention, a method of operating a garment steaming device includes the steps of actuating a pump to pump water from a reservoir to a steam generator, operating a first heating element of the steam generator at a first power level, and operating a second heating element of the steam generator at a second power level, wherein the first power level is substantially constant, and wherein the second power level is variable.

According to yet another embodiment of the present invention, a method of operating a garment steaming device includes the steps of providing power to a heating element of a steam generator, and actuating a pump to pump water from a reservoir to a main water bath and a secondary water bath of the steam generator. The secondary water bath has a volume that is less than a volume of the main water bath so as to generate steam more quickly from the water in the secondary water bath than from the water in the main water bath.

According to another embodiment of the present invention, a garment steaming device includes a housing having a reservoir for containing liquid therein, a head portion connected to the housing, and a steam generator contained within the head portion, the steam generator being in fluid communication with the reservoir for generating steam from the liquid contained in the reservoir. The steam generator includes a main water bath and a secondary water bath, the main water bath and the secondary water bath being in fluid communication with the reservoir for receiving liquid therefrom. The secondary water bath has a capacity that is less than a capacity of the main water bath to facilitate rapid generation of steam.

According to yet another embodiment of the present invention, a garment steaming device includes a housing having a reservoir for containing liquid therein, a head portion connected to the housing, a steam generator contained within the head portion, the steam generator being in fluid communication with the reservoir for generating steam from the liquid contained in the reservoir, and a control unit configured to control the pumping rate of the pump. The control unit is configured to control the pump to provide a first flow rate of fluid to the steam generator during a preheating mode of operation of the garment steaming device, and to control the pump to provide a second flow rate of fluid to the steam generator after the preheating mode of operation is complete, wherein the first flow rate is less than the second flow rate.

According to yet another embodiment of the present invention, a method of operating a garment steaming device includes the steps of providing a flow of fluid from a reservoir to a steam generator at a first flow rate during a first operational period, and increasing the flow of fluid from the reservoir to the steam generator to a second flow rate during a second operational period.

According to yet another embodiment of the invention, a garment steaming device includes a housing having a reservoir for containing liquid therein, a head portion connected to the housing, the head portion having a plurality of outlet apertures, a steam generator in fluid communication with the outlet apertures in the head portion, and having a main water bath in fluid communication with the reservoir for receiving the liquid from the reservoir, the steam generator being configured to generate steam from the liquid for passage to the outlet apertures in the head portion, a thermal detection device in thermal communication with the main water bath, and a foam metal material disposed in the main water bath.

BRIEF DESCRIPTION OF THE DRAWINGS

The present invention will be better understood from reading the following description of non-limiting embodiments, with reference to the attached drawings, wherein below.

DETAILED DESCRIPTION OF THE PREFERRED EMBODIMENT

Figure 1:
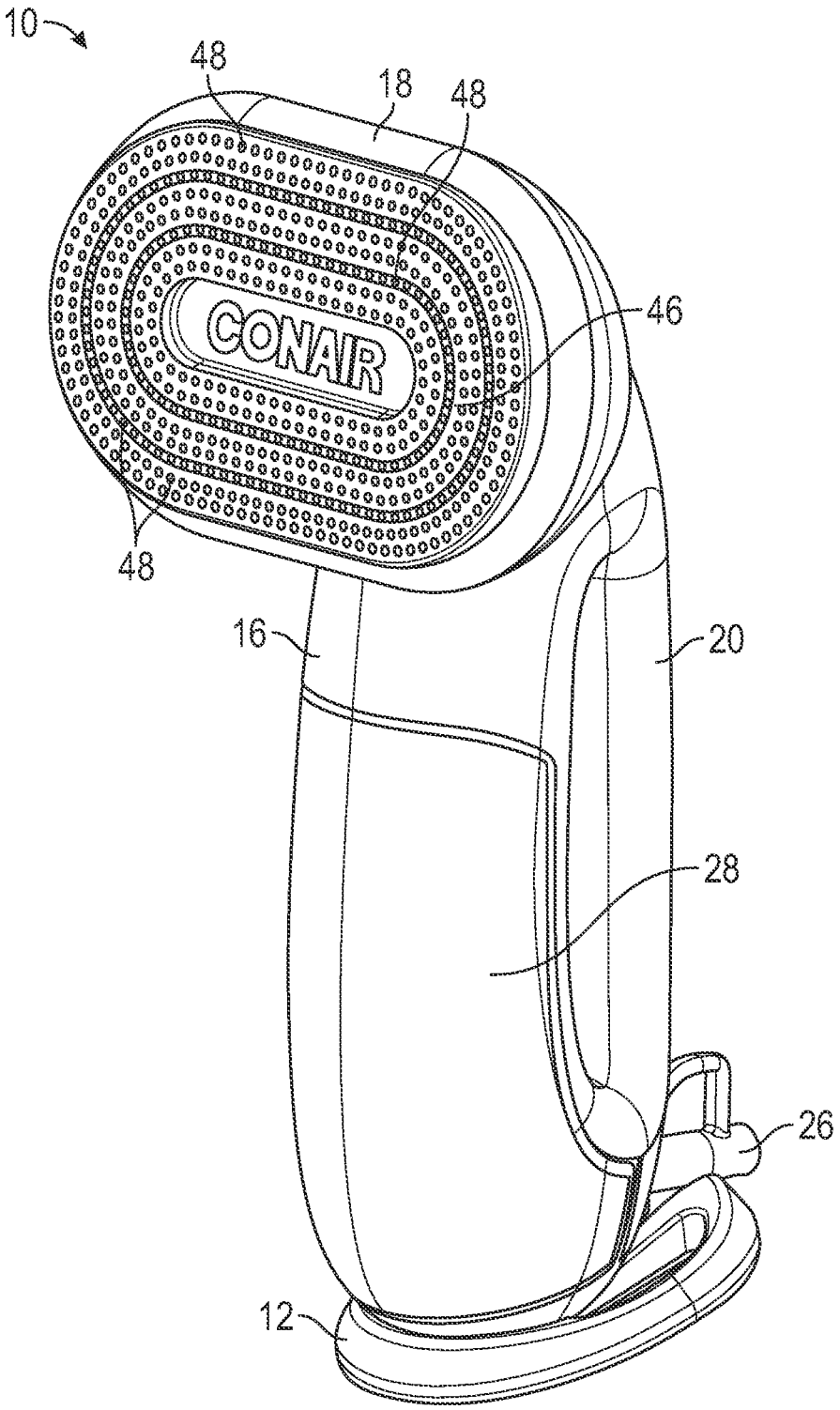
FIG. 1 is a front, perspective view of a garment steaming device according to an embodiment of the present invention.
Figure 4:
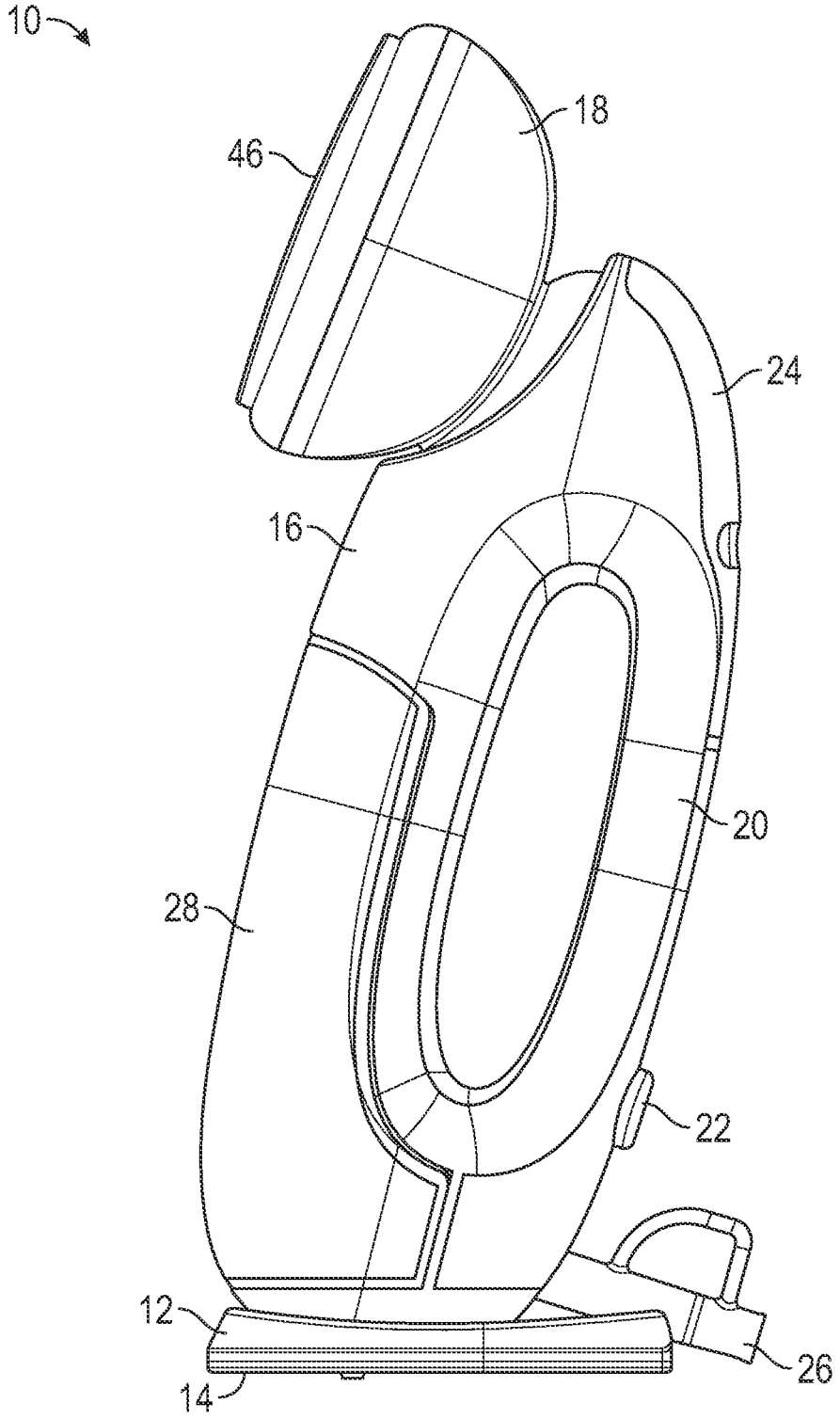
FIG. 4 is a right side elevational view of the garment steaming device of FIG. 1.

Referring to FIGS. 1-4, a garment steaming device 10 according to an embodiment of the present invention is illustrated. The garment steaming device 10 includes a base 12 having a generally planar bottom surface 14, a housing 16 supported by the base 12, and a head 18 pivotally connected to an upper end of the housing 16. The base 12 functions as a pedestal, enabling the device 10 to be placed on a flat surface, such as a countertop, when not in use. As best shown in FIG. 4, the housing 16 is generally oval in shape when viewed from the side, and includes an integrated handle 20 at the rear thereof that is dimensioned and configured for manual engagement by a user. A rear portion of the housing 16 includes a power button 22, the function of which will be described hereinafter. A power cord sleeve 26 (not shown) is connected to the distal, lower end of the housing 16, which is configured to receive a power cord to provide electricity to the garment steaming device 10. The power cord is configured to engage a suitable electrical outlet (e.g., a wall outlet, etc.). However, in other embodiments, any suitable source of electricity may be incorporated into the garment steaming device 10 including, but not limited to, a battery or rechargeable battery. As shown in FIG. 1 a water reservoir 28 is releasably connected to the front of the housing 16 and is contoured in conformance with the contours of the housing 16.

Figure 5:
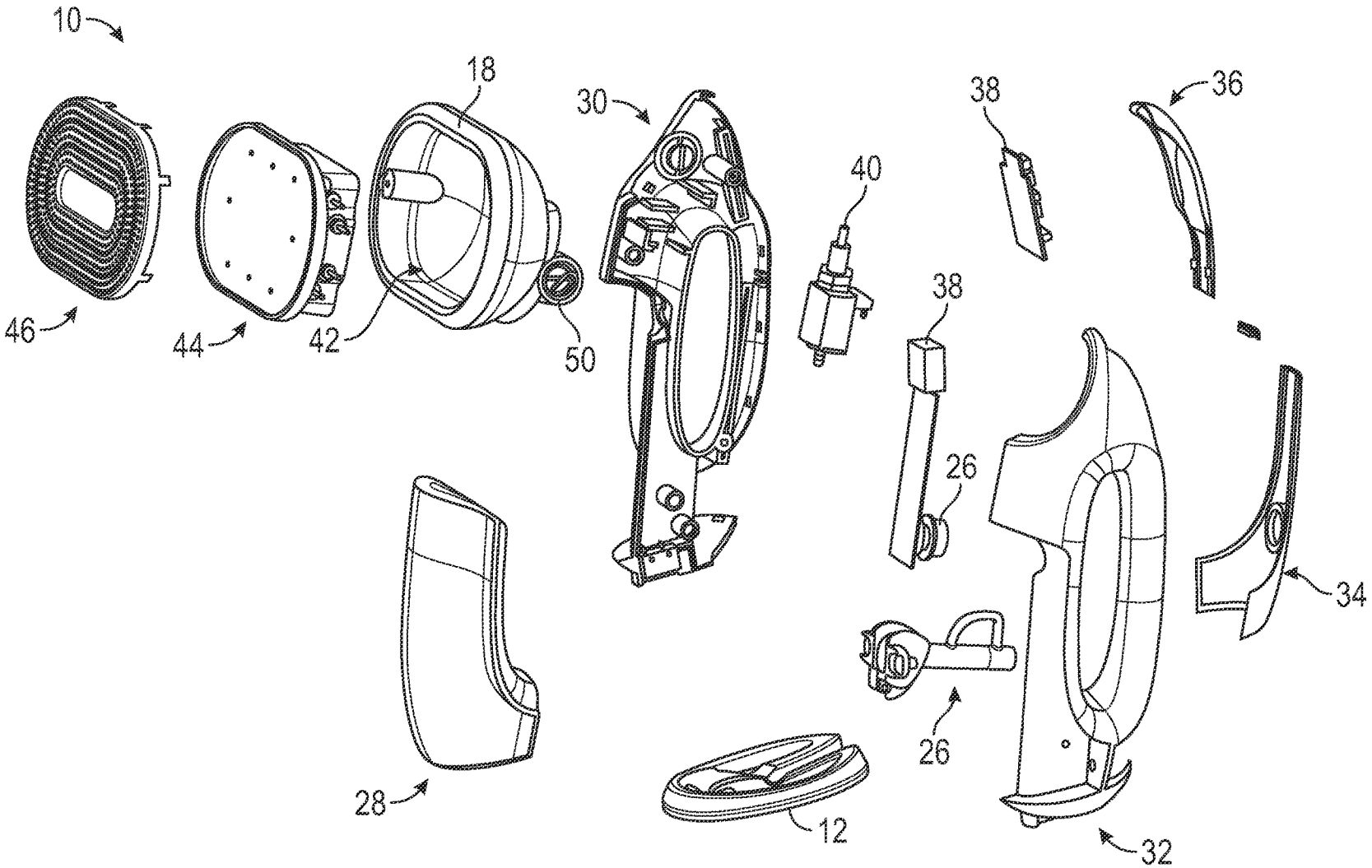
FIG. 5 is an exploded view of the garment steaming device of FIG. 1.
Figure 6:
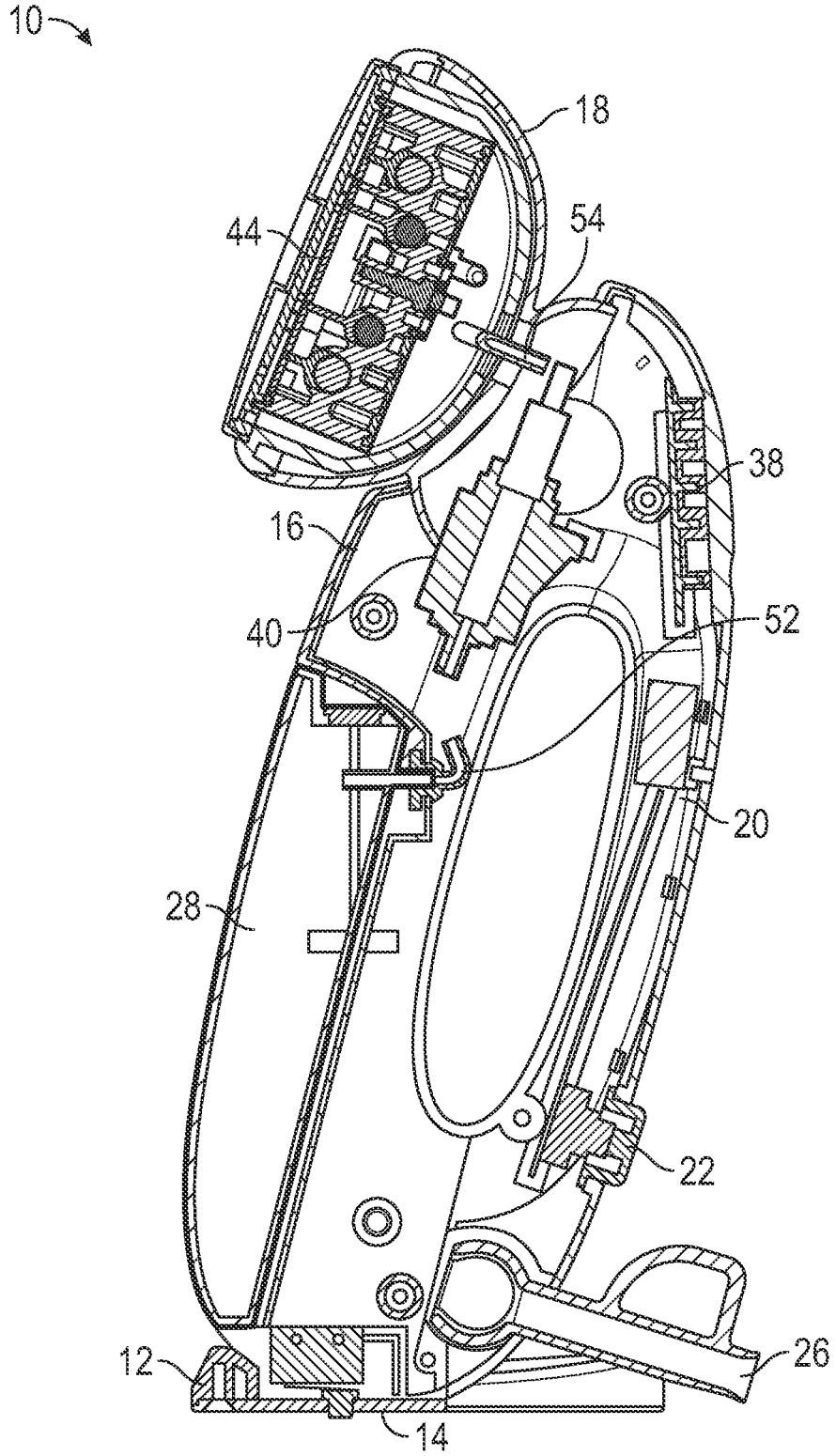
FIG. 6 is a right side, cross-sectional view of the garment steaming device of FIG. 1.

Turning now to FIG. 5, an exploded view of the garment steaming device 10 is shown, illustrating the primary components thereof. As illustrated therein, the housing 16 may be formed from a left-side housing portion 30, a right-side housing portion 32, a rear housing portion 34 and a control panel housing portion 36 that may be coupled to one another using an adhesive and/or suitable fasteners. As shown therein, the housing 16 contains one or more control units 38 and associated components (e.g., printed circuit boards) for controlling operation of the device 10, and a water pump 40. The head 18 of the garment steaming device 10, as also shown in FIG. 5, includes an interior space 42 for receiving a steam generator assembly 44. A soleplate 46 is dimensioned and configured to fit over the front of the head 18, enclosing the steam generator assembly 44 within the interior space 42, and includes a plurality of steam outlets 48. In an embodiment the soleplate 46 may be formed from plastic or metal, and may be configured to assist in ironing, Importantly, as disclosed above, the head 18 is pivotally connected to the housing 16, and may include a biasing mechanism such as a coil spring 50 that returns the head 18 to a default position with respect to the housing 16 when a biasing force on the head 18 is removed (see FIG. 35). As shown in FIG. 6, the pump 40 is in fluid communication with the water reservoir 28 and the steam generator assembly 44 through appropriate tubing 52, 54 to deliver water to from the reservoir 28 to the steam generator assembly 44. Collectively, the water pump 40 and steam generator assembly 44 may be referred to herein as a boiler system of the device 10.

Figure 8:
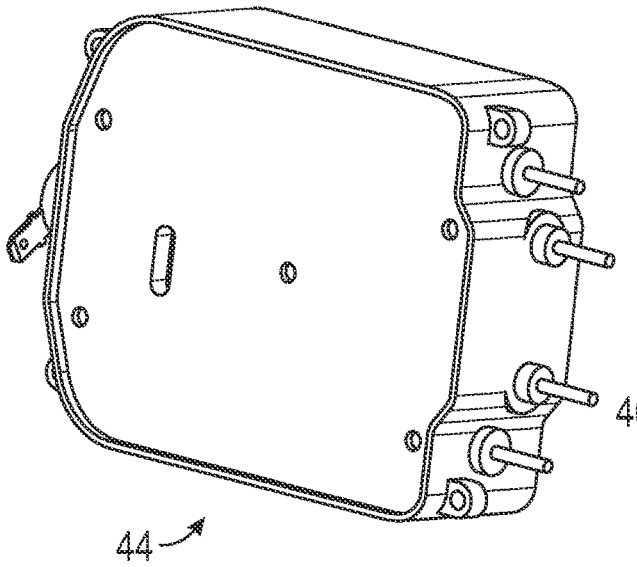
FIG. 8 is a perspective view of a steam generator assembly of the garment steaming device of FIG. 1.
Figure 7:
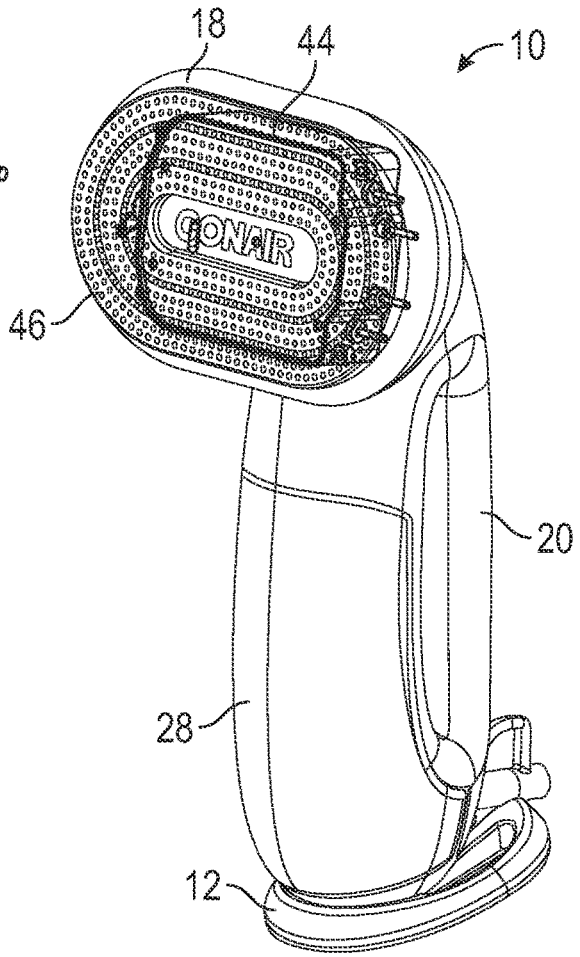
FIG. 7 is a partial transparent, perspective view of the garment steaming device of FIG. 1, illustrating the location of a steam generator assembly with a head of the garment steaming device.
Figure 9:
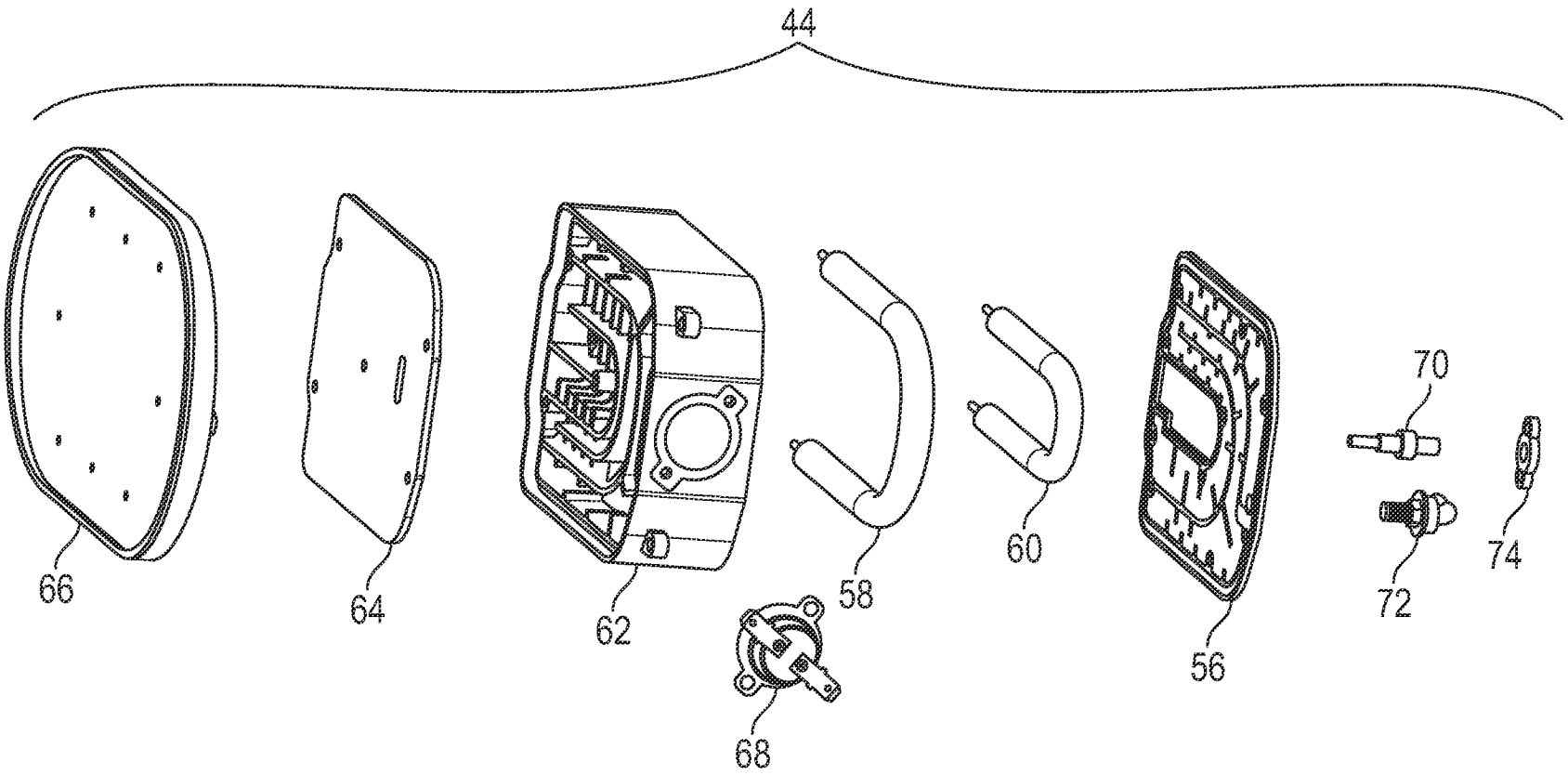
FIG. 9 is an exploded, perspective view of the steam generator assembly of FIG. 8.
Figure 10:
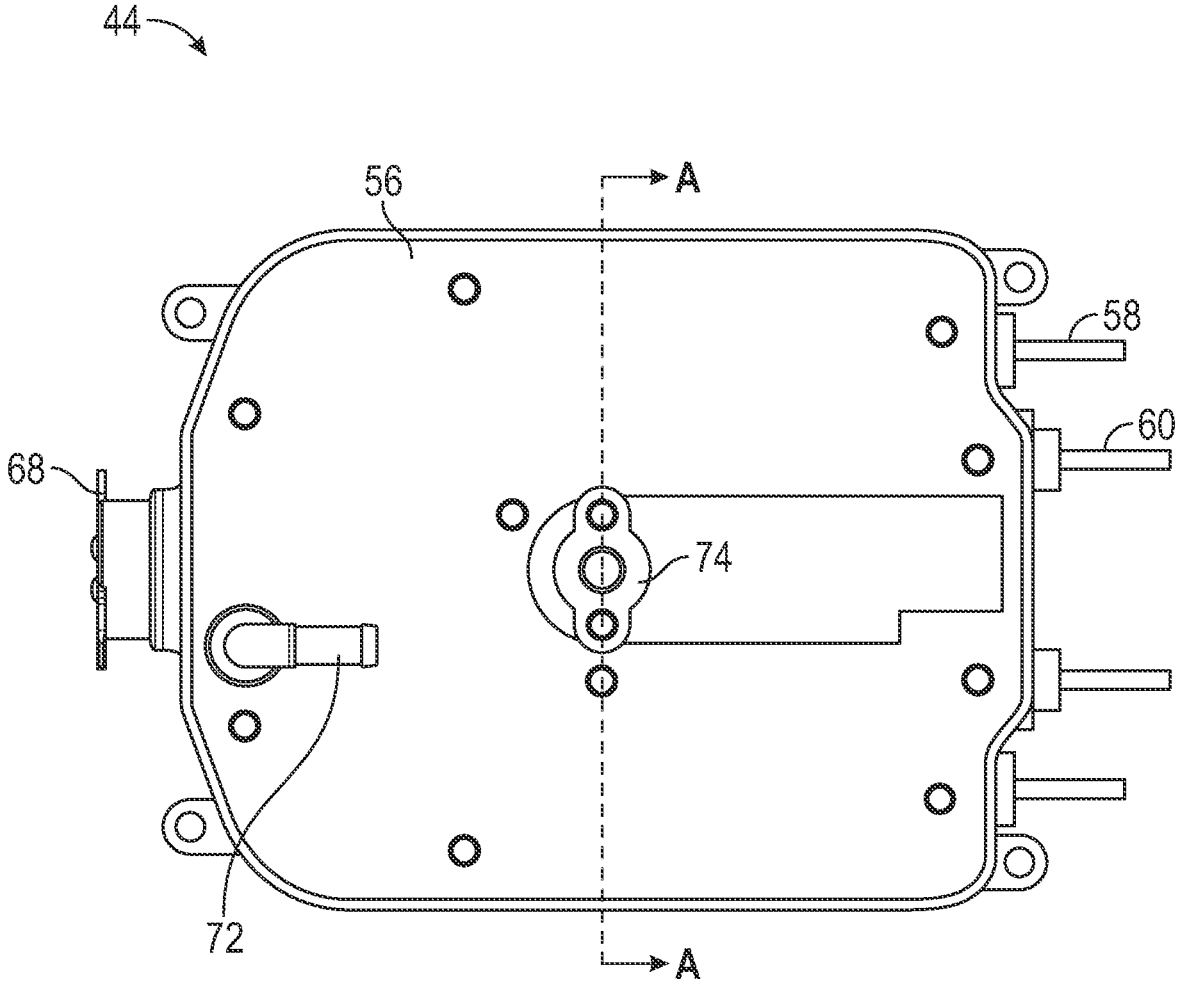
FIG. 10 bottom plan view of the steam generator assembly.

Turning now to FIGS. 7-9, the steam generator assembly 44 includes a rear cover member 56, a primary heating element 58, at least one secondary heating element 60, a body 62, a first front cover member 64, and a second front cover member 66. The heating elements 58, 60 are electrically connected to the supply of electrical power for powering the heating elements 58, 60. As also shown in FIG. 9, the steam generator assembly 44 includes a thermostat 68 for thermal detection and/or control of the primary heating element 58, a NTC thermistor/sensor 70 with relay/triac for thermal detection/sensing of the secondary heating element 60, and a water inlet tube 72 allowing for water pumped by pump 40, from reservoir 28, to enter the steam generator assembly 44.

Figure 11:
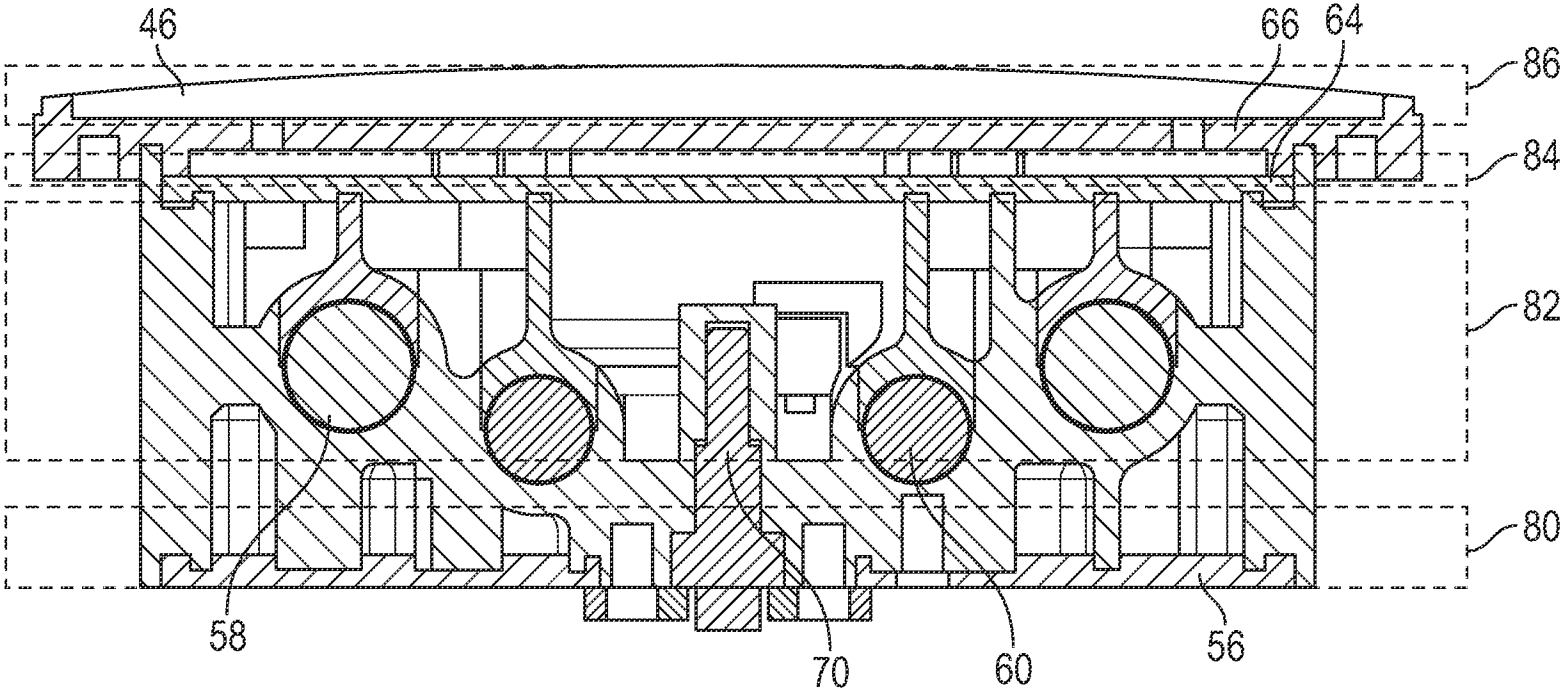
FIG. 11 is a cross-sectional view of the steam generator assembly taken along line A-A of FIG. 10.
Figure 12:
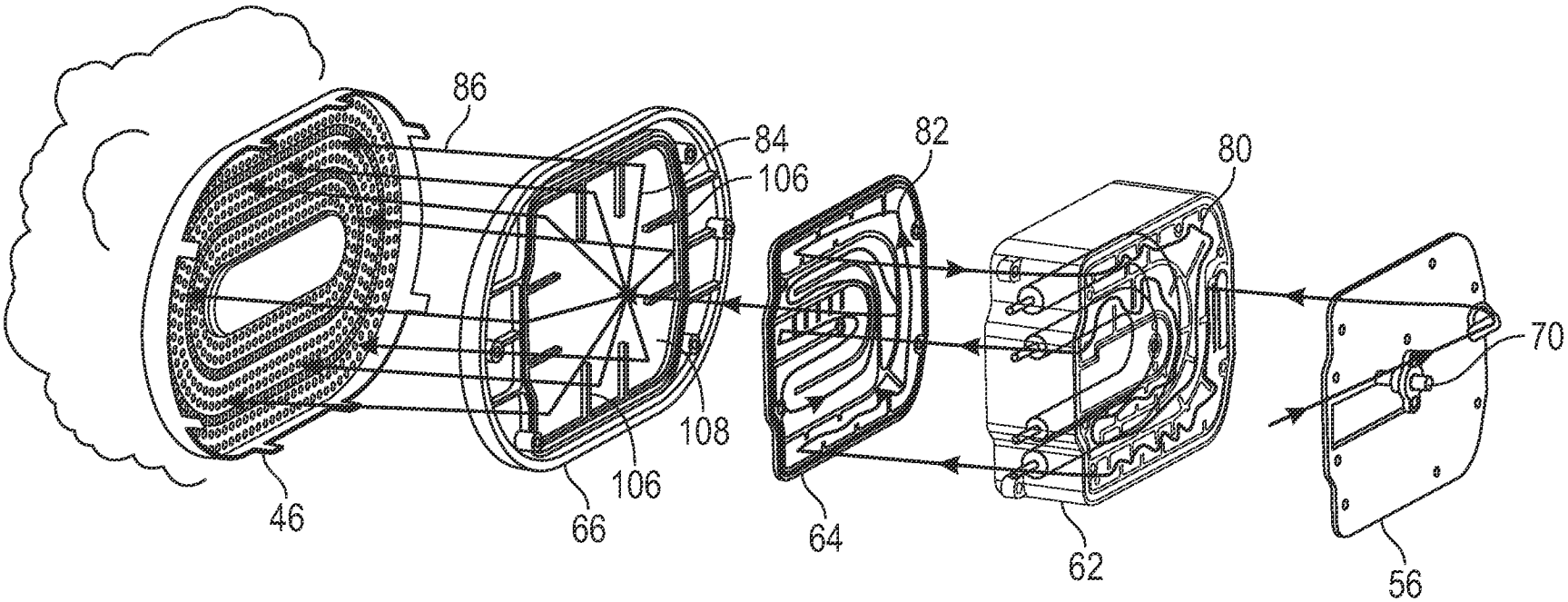
FIG. 12 is an exploded perspective view of the steam generator assembly illustrating the flow path of steam therethrough.

FIGS. 10-29 illustrate the internal configuration of the steam generator assembly 44 and the water/steam flowpath therethrough. With particular reference to FIGS. 11 and 12, water enters through inlet 72 in the rear cover member 56 where it is routed through four adjacent layers of the steam generator assembly 44. In particular, the body 62 of the steam generator assembly 44 defines first and second layers 80, 82, respectively, that sandwich/surround the primary heating element 58 and the secondary heating element 60, where the majority of steam generation takes place. A third layer 84 is defined between the first front cover member 64 and the second front cover member 66, and a fourth layer 86 is defined between the second front cover member 64 and the soleplate 46. The first and second layers 80, 82 (as well as the cover members 56, 64, 66) are preferably formed from a conductive material such as metal, which enables the layers to function as a heat sink, quickly absorbing heat produced by the heating elements 58, 60. This enables the absorbed heat to then be transferred to water passing through the flow passages of each layer, as discussed in detail below.

Figure 13:
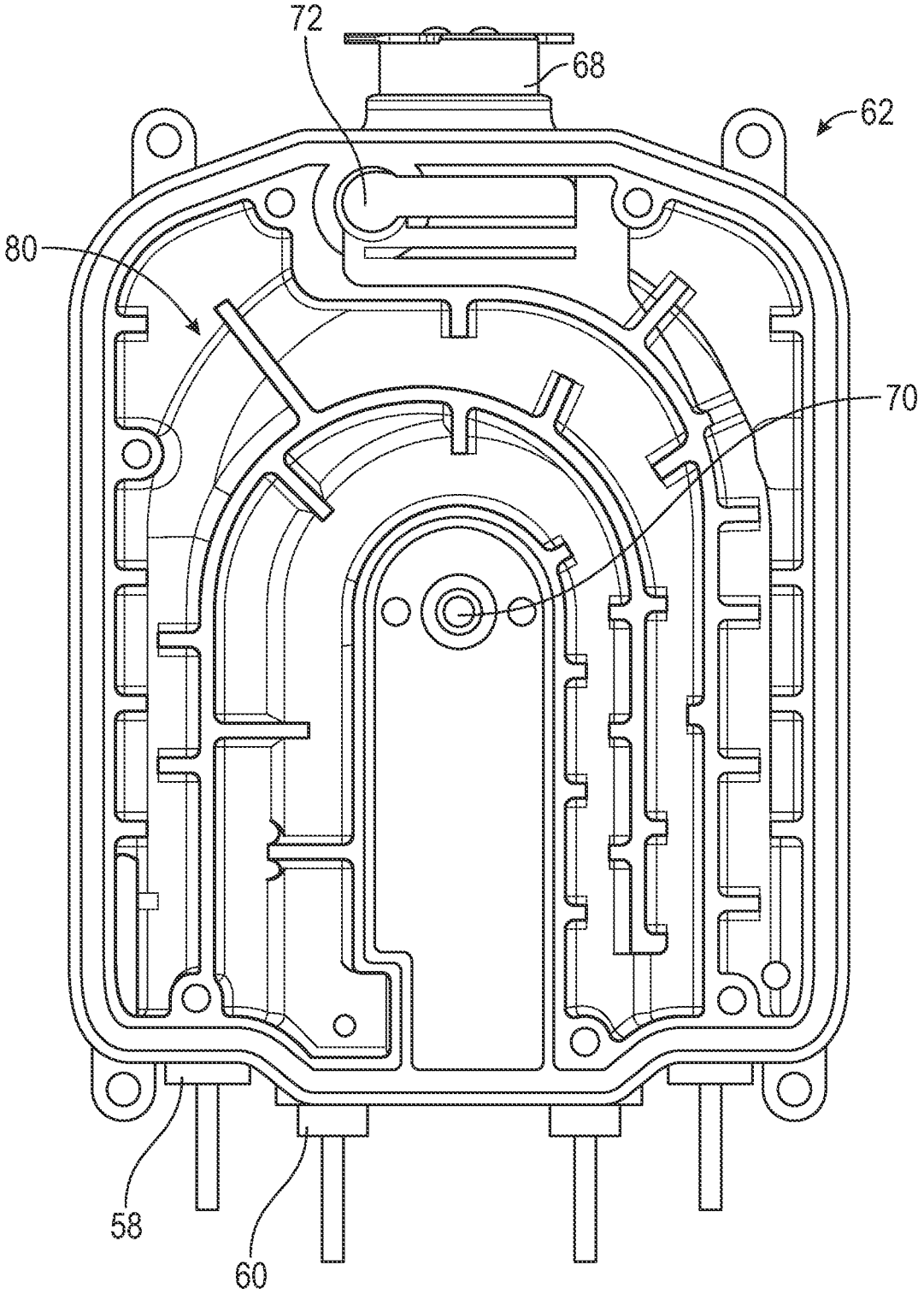
FIG. 13 is a top plan view of a first layer of the steam generator assembly and a steam flow path defined thereby.
Figure 14:
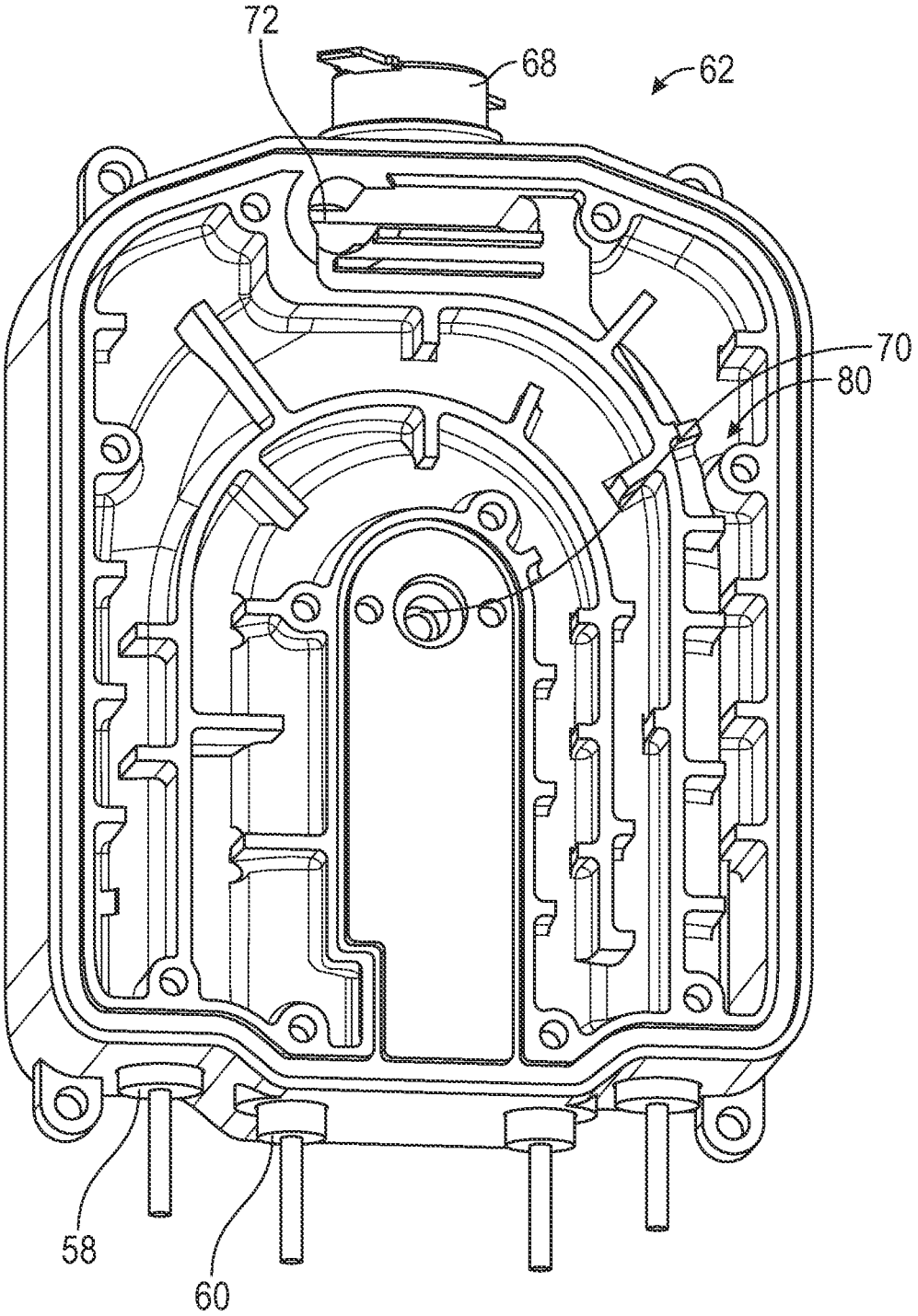
FIG. 14 is a perspective view of the second layer of the steam generator assembly and the steam flow path defined thereby.
Figure 15:
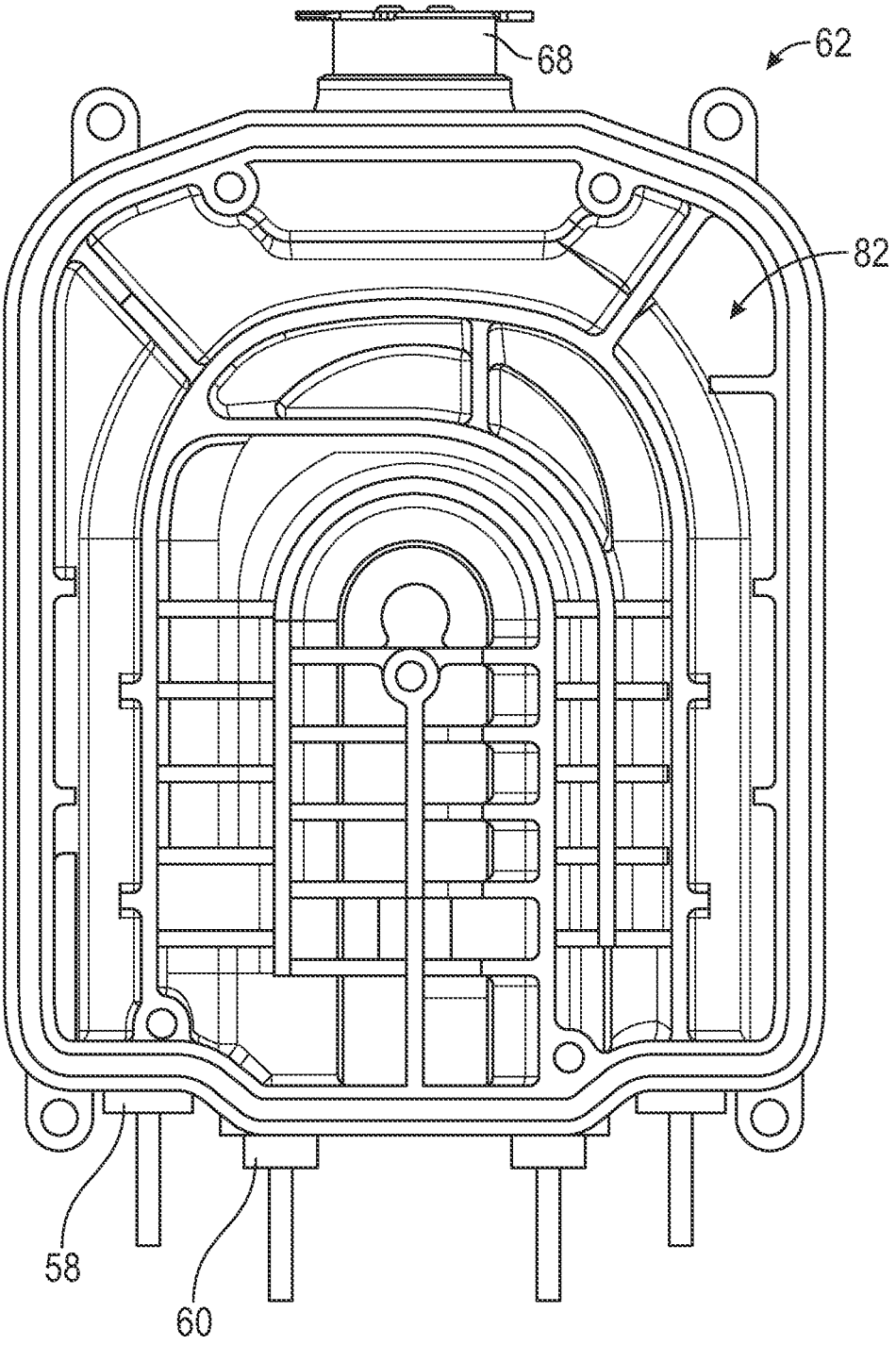
FIG. 15 is a top plan view of a second layer of the steam generator assembly and a steam flow path defined thereby.
Figure 16:
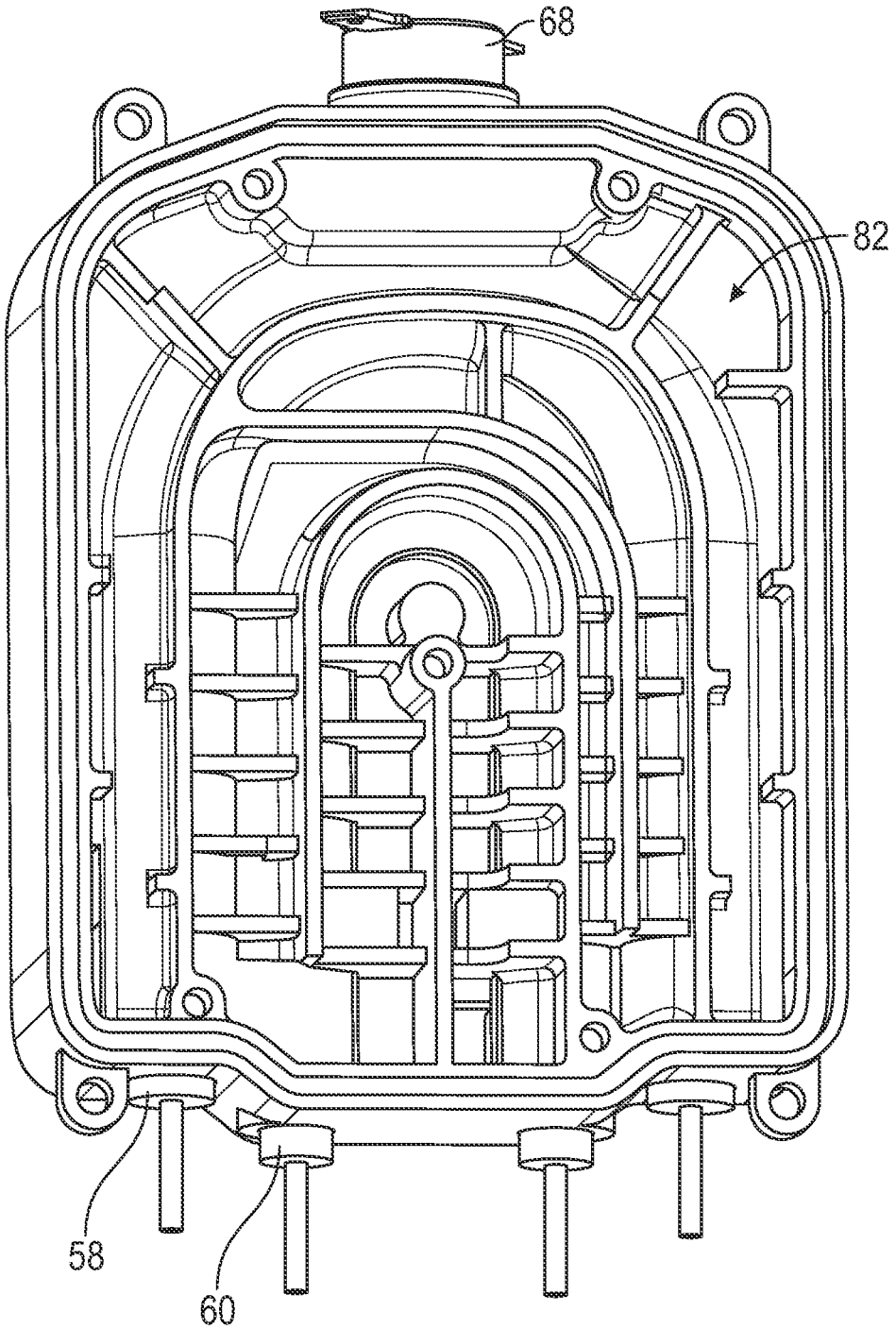
FIG. 16 is a perspective view of the second layer of the steam generator assembly and the steam flow path defined thereby.
Figure 17:
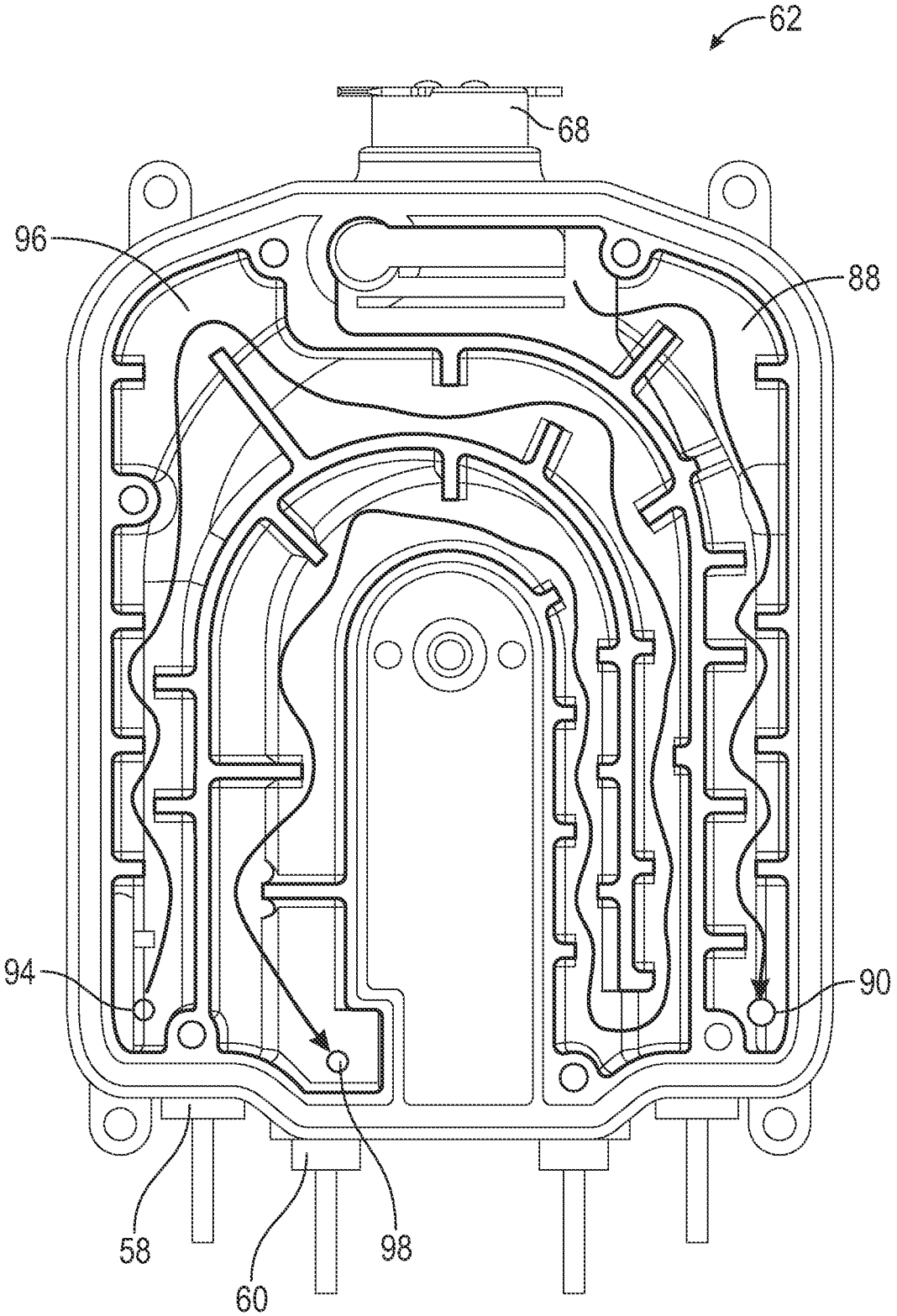
FIG. 17 is a top plan view showing the first layer of the steam generator assembly and the steam flow path defined thereby.
Figure 18:
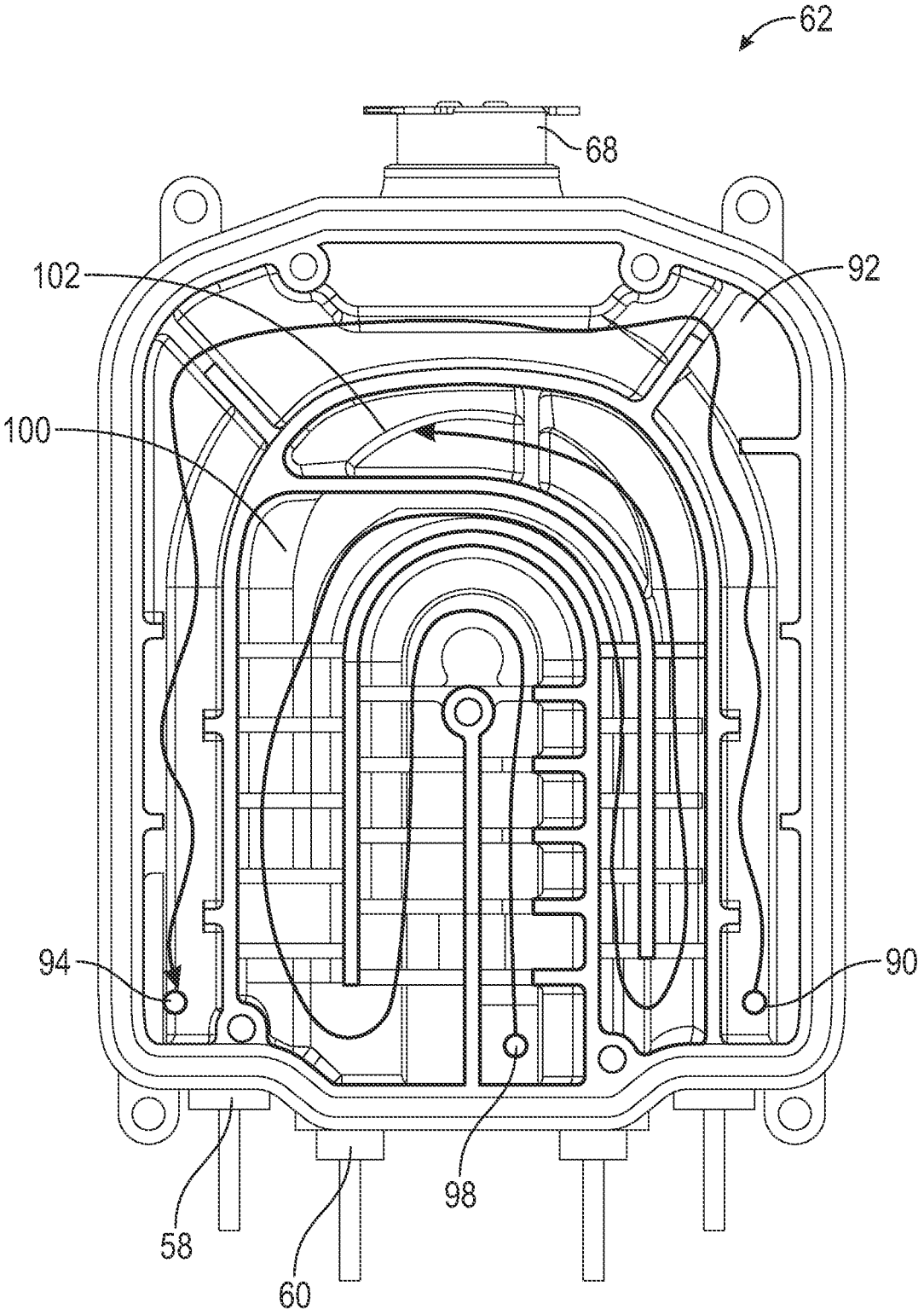
FIG. 18 is a top plan view showing the second layer of the steam generator assembly and the steam flow path defined thereby.
Figure 20:
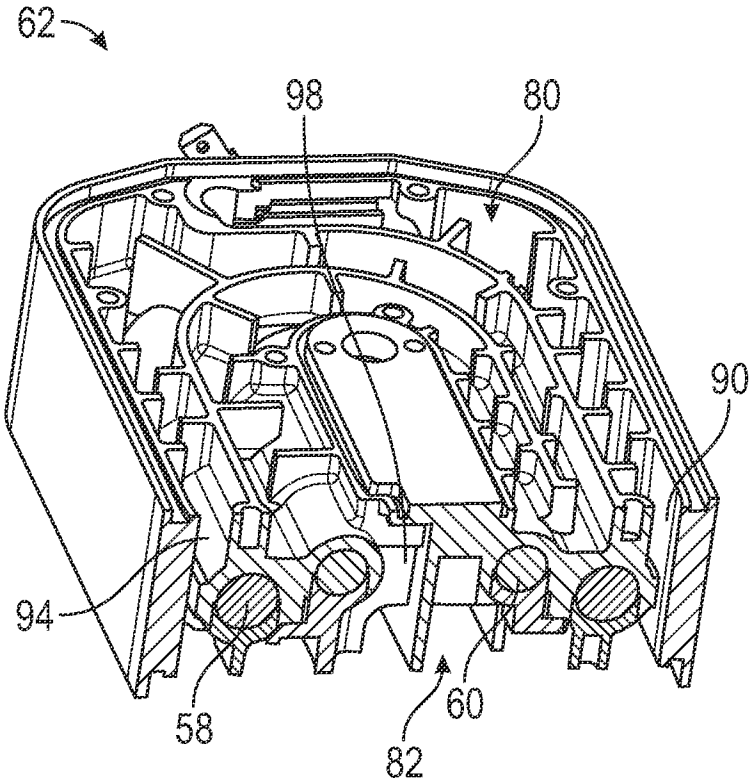
FIG. 20 is another perspective view of the steam generator assembly illustrating the passages that fluidly connect the first layer with the second layer.
Figure 19:
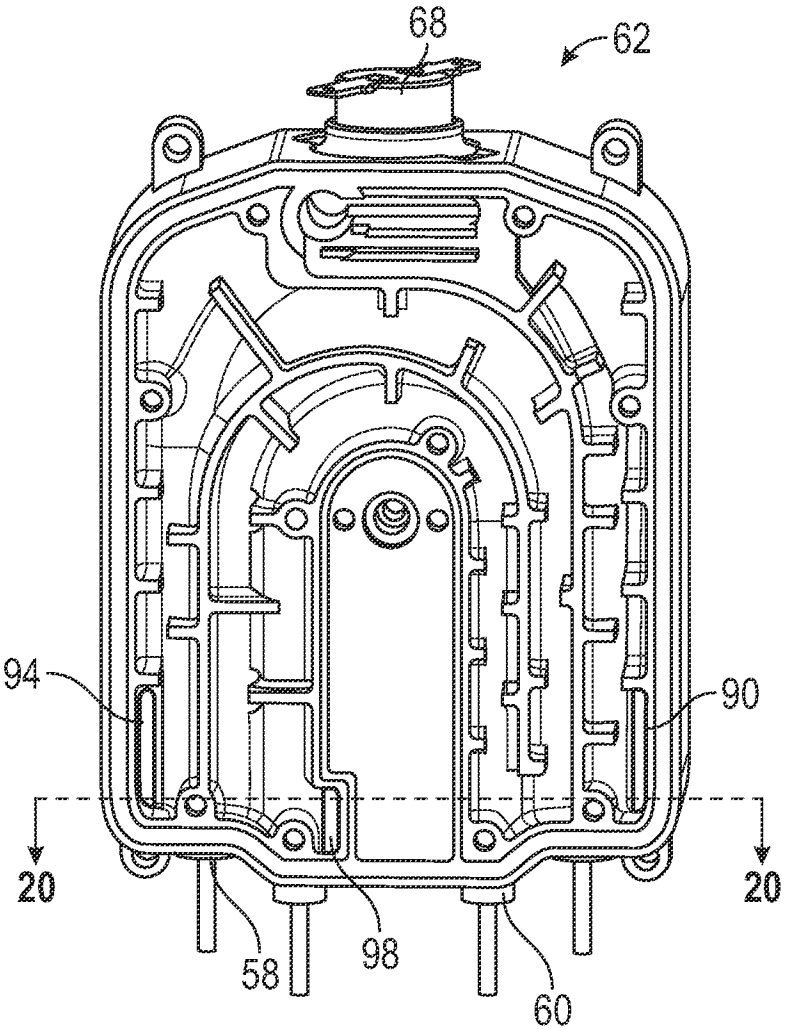
FIG. 19 is a perspective view of the steam generator assembly illustrating passages that fluidly connect the first layer with the second layer.
Figure 21:
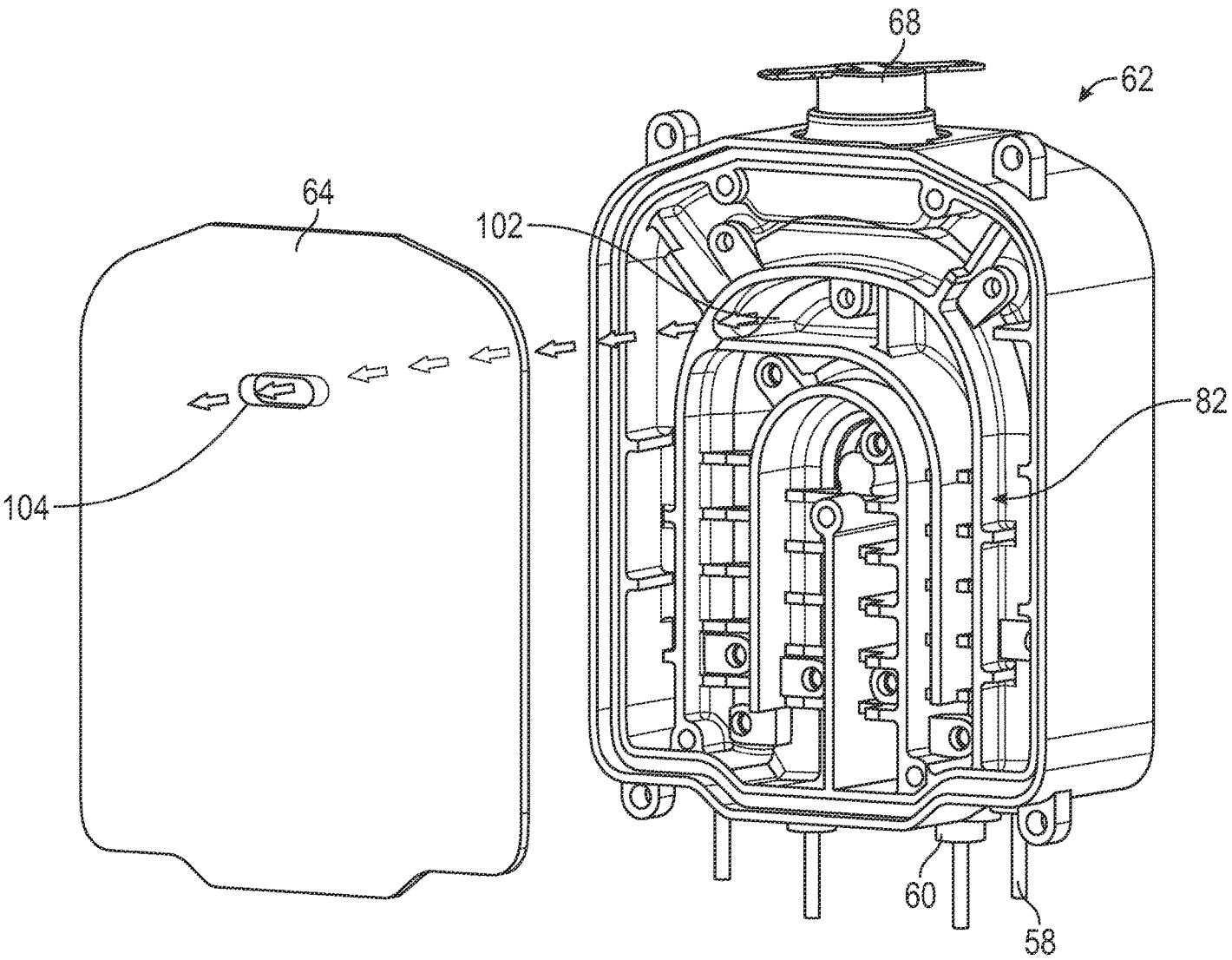
FIG. 21 is a perspective view of the steam generator assembly, illustrating the manner in which steam exits the second layer of the steam generator assembly.

FIGS. 13 and 14 illustrate the configuration of the first layer 80 within the body 62 of the steam generator assembly 44, and the steam flowpath defined thereby, while FIGS. 15 and 16 illustrate the configuration of the second layer 82 within the body of the steam generator assembly 44, and the steam flowpath defined thereby. As shown therein, the first and second layers 80, 82 define tortuous pathways that ensure that the water/steam traveling therethrough contacts the boundaries of the flow paths to provide for heating of the water/steam.

With specific reference to FIGS. 17-20, in operation, water is pumped, via pump 40, from the reservoir 28 to the water inlet 72, where it first enters a first zone 88 in the first layer 80. The water travels through the first zone 88 within the first layer 80 where it is heated to produce water/steam. The water/steam then passes through a first channel or passageway 90 that fluidly interconnects the first zone 88 of the first layer 80 and a second zone 92 in the second layer 82. The water/steam then travels through the second zone 92 within the second layer 82 where it is further heated, and passes through a channel or passageway 94 that fluidly interconnects the second zone 92 of the second layer 82 and a third zone 96 of the first layer 80. The water/steam then travels through the third zone 96 within the first layer 80 where it is further heated, and passes through a channel or passageway 98 that fluidly interconnects the third zone 96 of the first layer 80 with a fourth zone 100 in the second layer 82. The water/steam then travels through the fourth zone 100 of the second layer 82 where it is further heated, to a distal end 102 of the fourth zone 100, ultimately exiting the fourth zone 100 through outlet 104 in the first cover member 64 that encloses the second layer 82 and flow passages thereof.

In summary, the water enters the first layer 80 through an inlet 72, travels through a first portion of the first layer 80, passes into the second layer 82, travels through a first portion of the second layer 82, passes back into the first layer 80, travels through a second portion of the first layer 80, passes back into the second layer 82, travels through a second portion of the second layer 82, then exits the second layer 82 through an outlet 102 in the first front cover member 64. The steam then enters the third layer 84, as discussed hereinafter. Generally, the first and second zones 88, 92 are located and configured so as to track the shape/contour of the primary heating element 58, while the third and fourth zones 96, 100 are located and configured so as to track the shape/contour of the secondary heating element 60. Importantly, this particular configuration results in a more balanced temperature of the steam generator, which facilitates the transfer of heat to the water/steam passing therethrough. Moreover, this multi-layer steam generator assembly design increases the length of steam travel within the first and second layers, and ensures that the steam path closely surrounds the heating elements to provide for better heat transfer and to keep the heat concentrated at the center of the steam generator assembly. As a result, heat energy loss as the external surface of the steam generator assembly is minimized, which maximizes steam generating efficiency.

Figure 22:
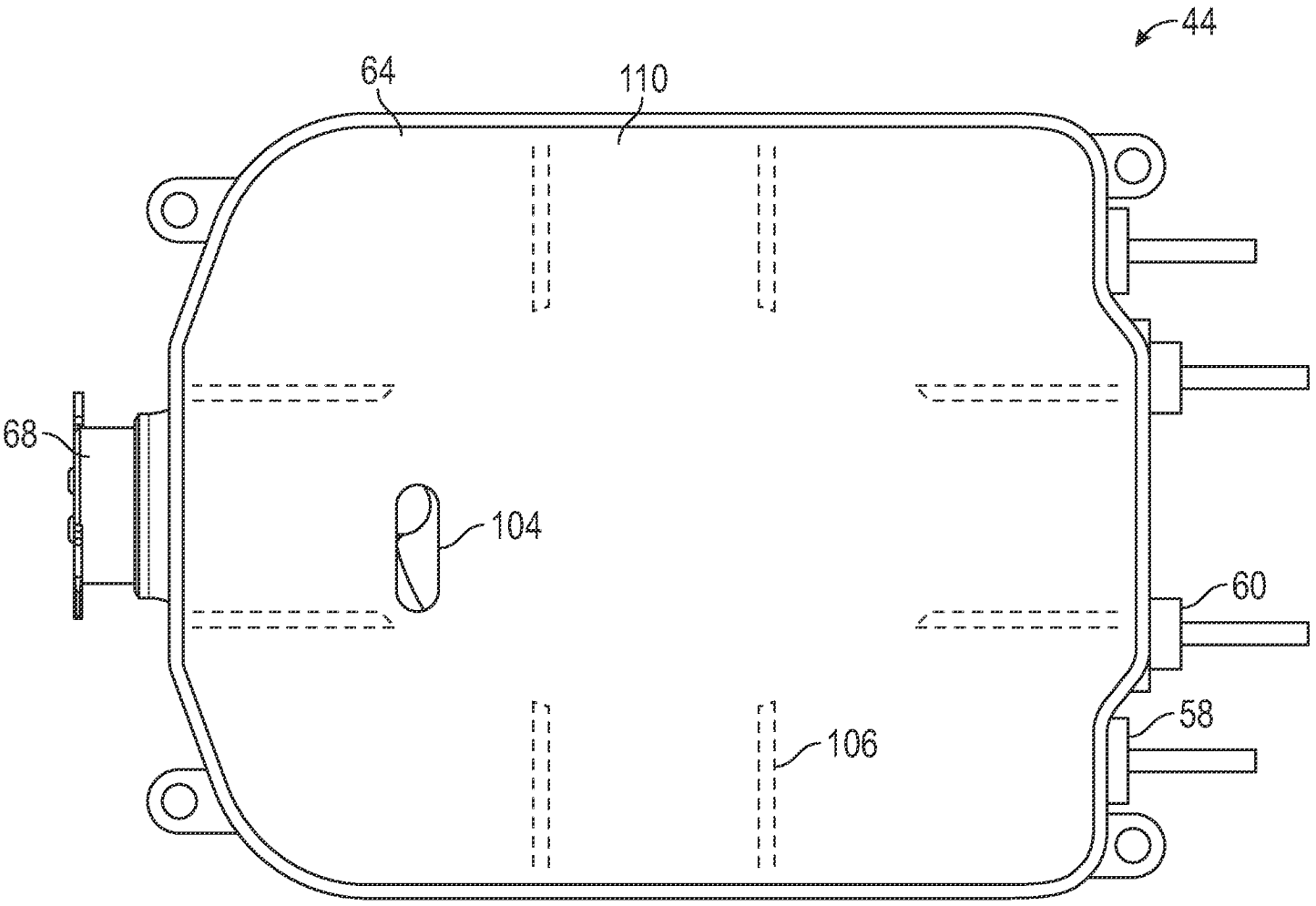
FIG. 22 is a top plan view of the steam generator assembly, illustrating a third layer thereof.
Figure 23:
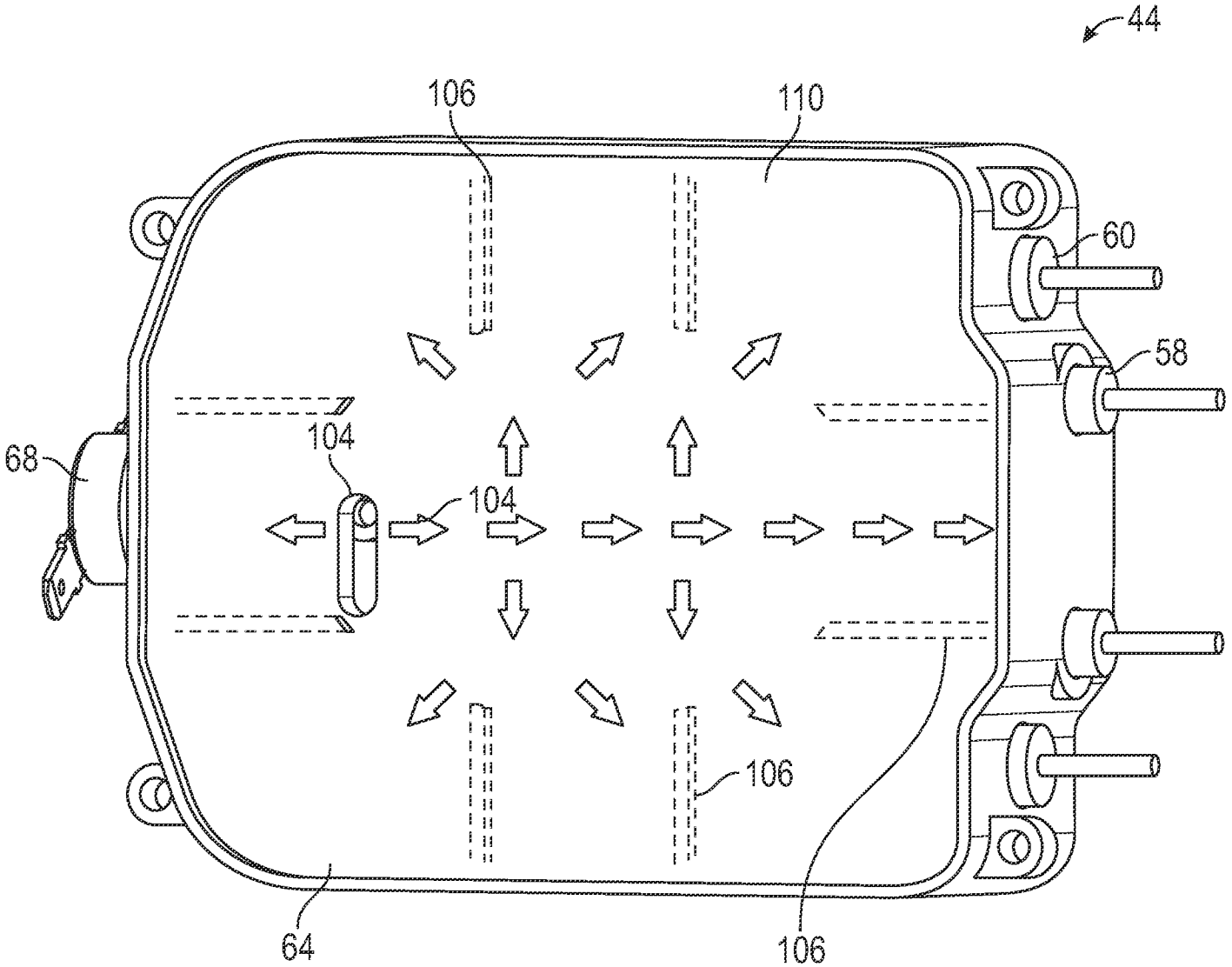
FIG. 23 is a top plan view of the steam generator assembly, illustrating a direction of steam travel within the third layer.
Figure 24:
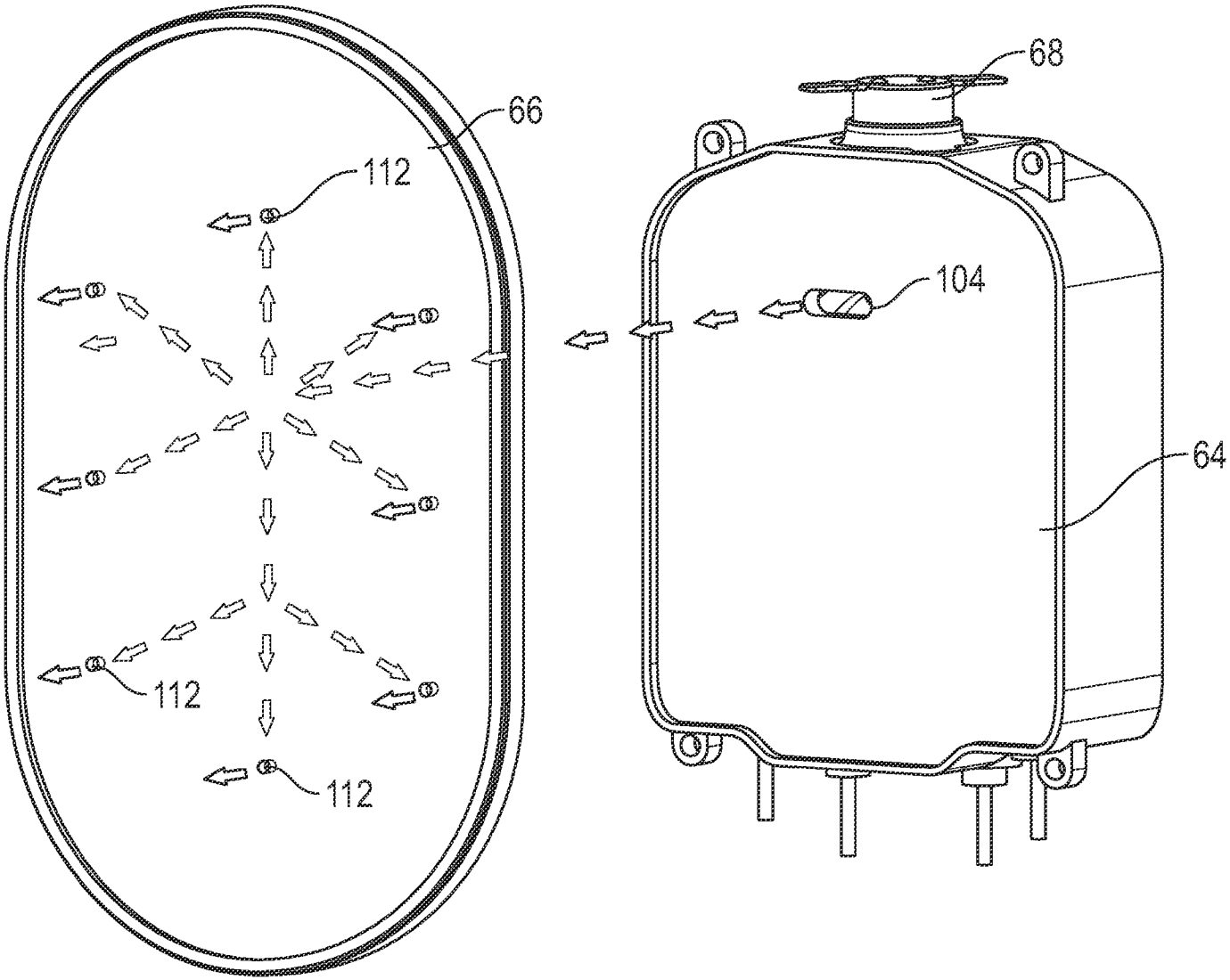
FIG. 24 is an exploded, perspective view of the steam generator assembly, illustrating the passage of steam out of the third layer.
Figure 25:
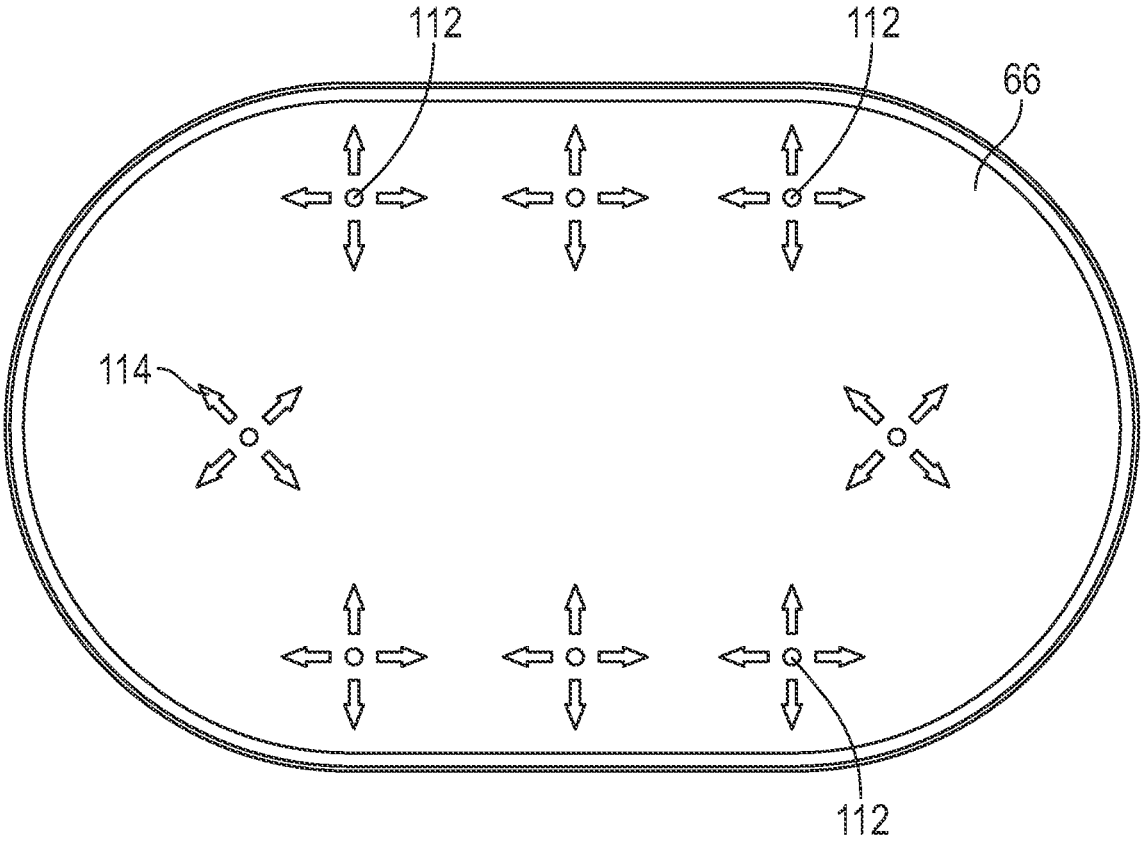
FIG. 25 is a top plan view of the steam generator assembly, illustrating the direction of travel of steam after exiting the third layer.

FIGS. 22 and 23 illustrate the configuration of the third layer 84 of the steam generator assembly 44 that lies between the first front cover member 64 and the second front cover member 66, which receives the steam from outlet 102 in the first front cover member 64. The dashed lines indicate partition walls 106 that extend from the inside surface 108 of the second front cover member 66 and contact the opposed surface 110 of the first front cover member 64. These partition walls 106 limit/control the direction of steam flow within the third layer 84 (where the arrows indicate steam flow within the third layer 84). As shown in FIGS. 24 and 25, steam is permitted to exit the third layer 84 through apertures 112 in the second front cover member 66, and expand outwardly in all directions as indicated by arrows 114 in FIG. 25. Importantly, the third layer 84 functions to spread the generated steam out evenly across the second front cover member 66, for even distribution to the soleplate 46 through apertures 112.

Figure 29:
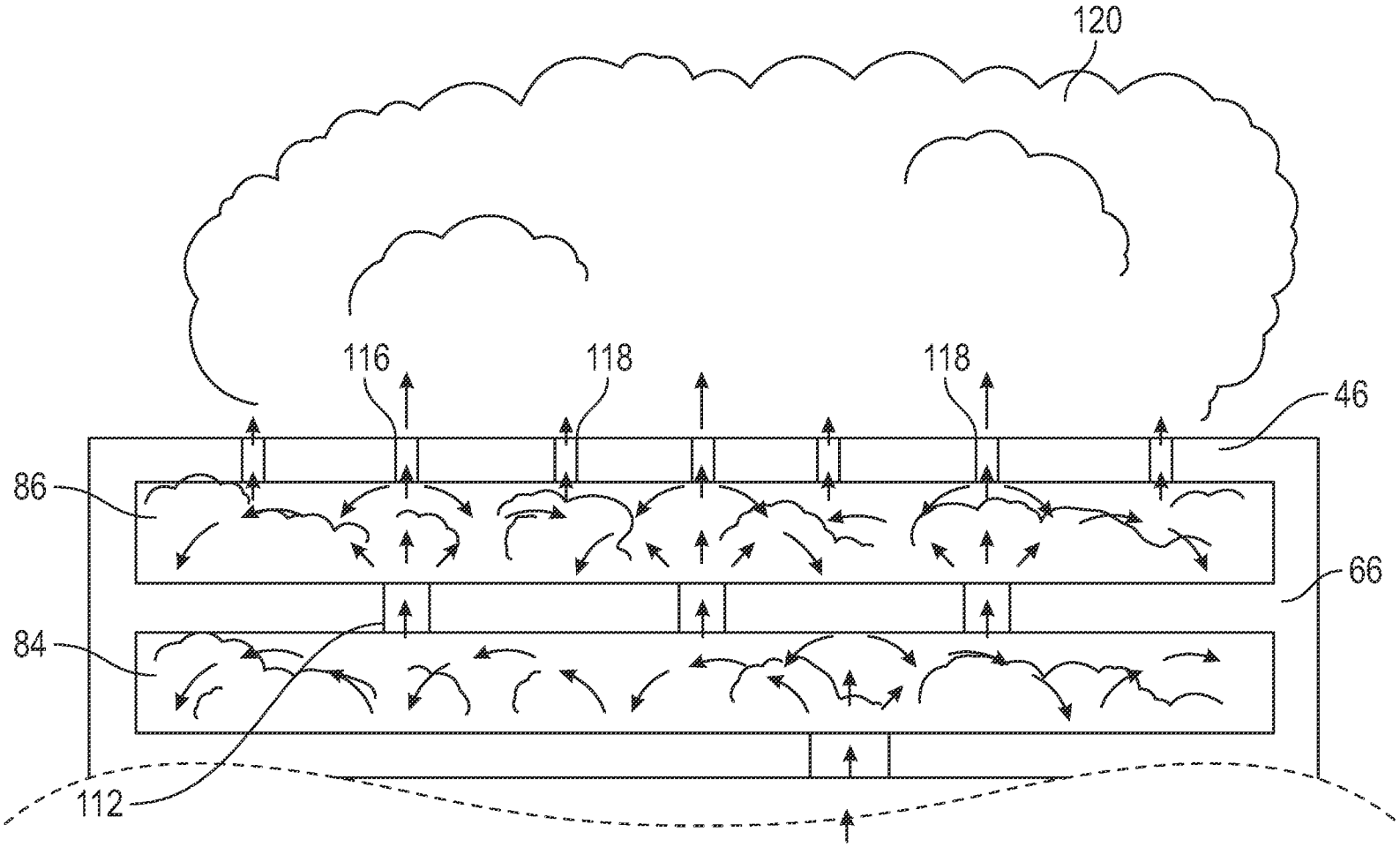
FIG. 29 is a simplified, cross-sectional view of a portion of the steam generator assembly, illustrating passage of steam from the second front cover member, into the fourth layer, and out of the garment steaming device through the soleplate.

FIGS. 26-29 show the flow of steam from the second front cover member 66, into the fourth layer 86, and out of the garment steaming device 10 through the soleplate 46. In particular, as shown therein, the fourth layer 86 receives steam from the apertures 112 in the second front cover member 66, where it is then exits the device 10 through the steam outlets 48 in the soleplate 46. With particular reference to FIG. 29, the steam outlets 48 in the soleplate 46 include primary steam outlets 116 and secondary steam outlets 118. As shown therein, the primary steam outlets 116 are substantially aligned with the apertures 112 in the second front cover member 66, while the secondary steam outlets 118 are laterally offset from the apertures 112. Importantly, the alignment of the primary steam outlets 116 with the apertures 112 in the second front cover member 66 provide for a more direct and high-pressure steam output therethrough as compared to the secondary steam outlets 118, as described below.

Figure 26:
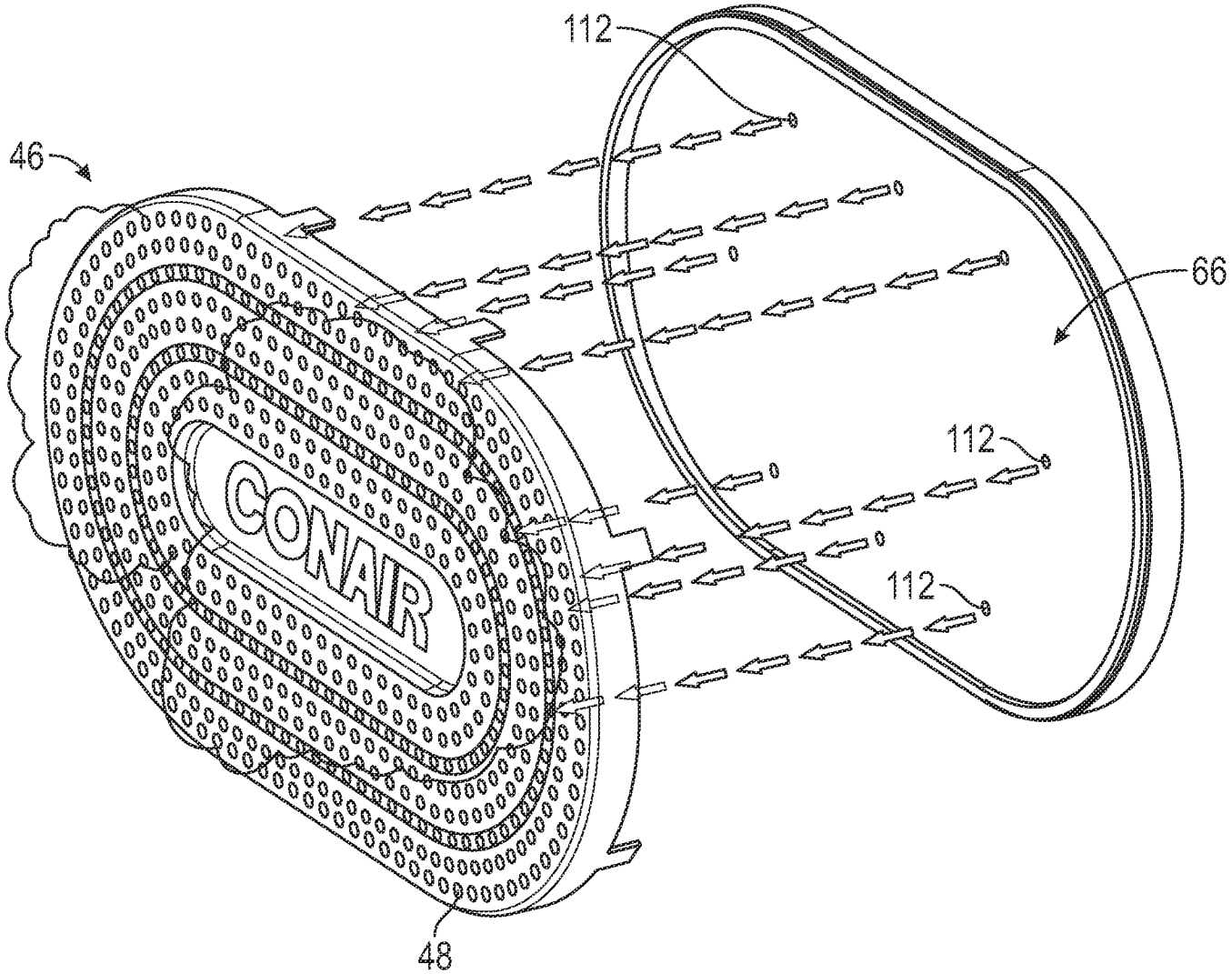
FIG. 26 is an exploded, perspective view of the soleplate and second front cover member of the steam generator assembly, illustrating the fourth layer thereof.
Figure 27:
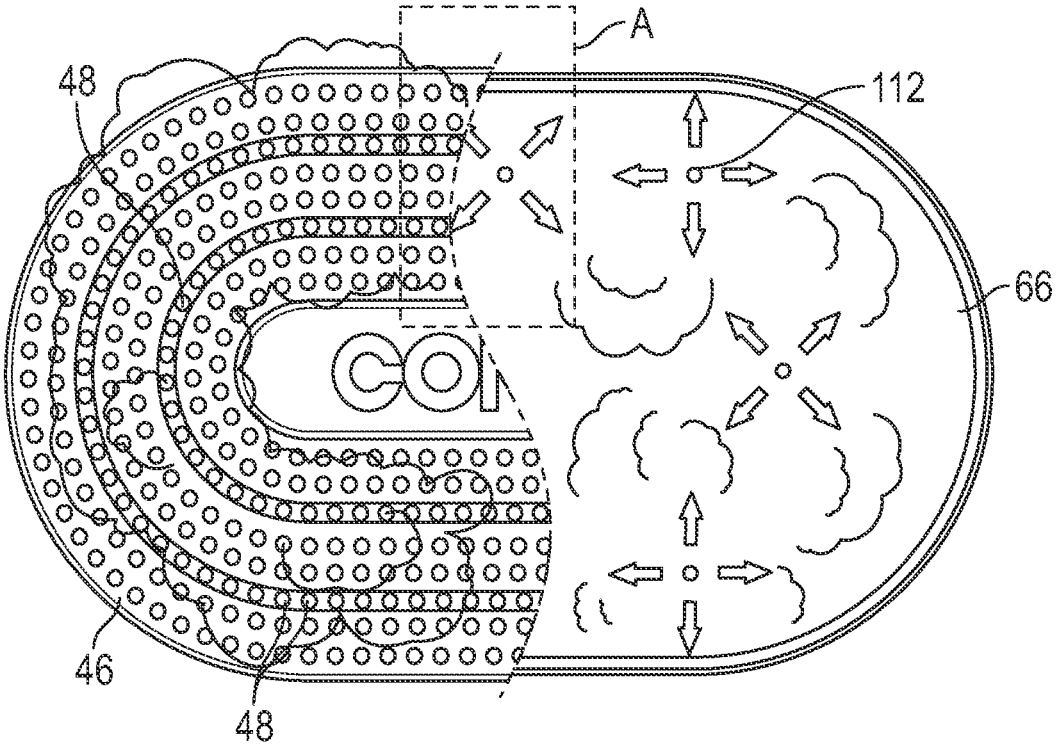
FIG. 27 is a partial-cutaway, top plan view of the soleplate of the steam generator assembly, illustrating the fourth layer.
Figure 28:
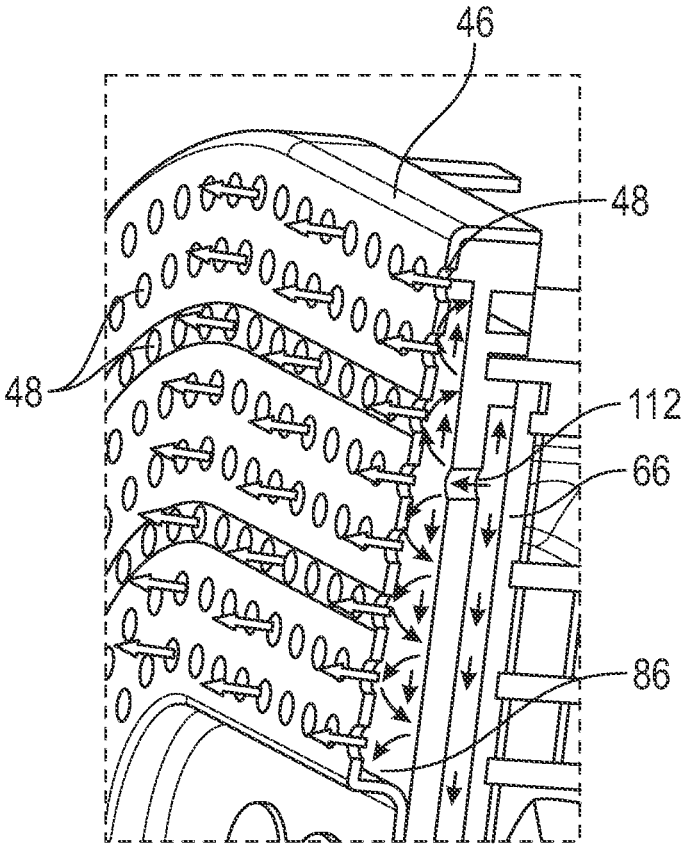
FIG. 28 is an enlarged, cross-sectional view of area A of FIG. 27.

As best illustrated in FIG. 26, the steam outlets 48 in the soleplate 46 are distributed over a substantial entirety of the area of the soleplate 46. In an embodiment, there may be 30 or more steam outlets 48 in the soleplate 46. This is in contrast to existing devices which only have a small number of steam outlets (which has typically been necessary to ensure sufficient steam pressure). In addition, as shown in FIG. 26, there are many fewer apertures 112 in the second front cover member 66 than there are outlets 48 in the soleplate 46. Moreover, in an embodiment, the steam outlets 48 in the soleplate 46 (i.e., the primary steam outlets 116 and the secondary steam outlets 118) have a diameter and/or outlet area that is less than the diameter and/or outlet area of the apertures 112 in the second front cover member 66. This allows steam that does not directly exit through the primary steam outlets 116 to spread out within the fourth layer 86. This allows a high steam pressure to build up within the fourth layer 86. This combination of few steam outlets in the second front cover member 66 as compared to the soleplate 46, and the large number of steam outlets distributed throughout the entire surface area of the soleplate, allows high-pressure steam to be output across the entire soleplate area, providing for full-coverage steam and thus greatly improving steam ironing efficiency as compared to prior art devices.

The function of the fourth layer 86 are therefore two-old: to spread the steam throughout the soleplate 46 to allow for a large steam output area (i.e., larger than the area of the steam generator assembly), and to pressurize the steam before it exits the device 10 through the soleplate 46. As indicated above, the primary steam outlets 116 provide for a more direct and high-pressure steam output from the device 10. Moreover, because the diameter/outlet area of the outlets 48 in the soleplate 46 is less than that of the apertures 112 in the second front cover member 66, steam spreads out within the fourth layer 86. After the steam distributes within the fourth layer 86, it exits the secondary steam outlets 118 at a relatively low pressure (as compared to the steam exiting from the primary steam outlets 116). As a result, the high steam pressure at the primary steam outlets 116 drives low steam pressure at the secondary steam outlets 118, thus creating a large steam cloud 120 that extends a substantial distance from the front face of the soleplate 46.

Figure 30:
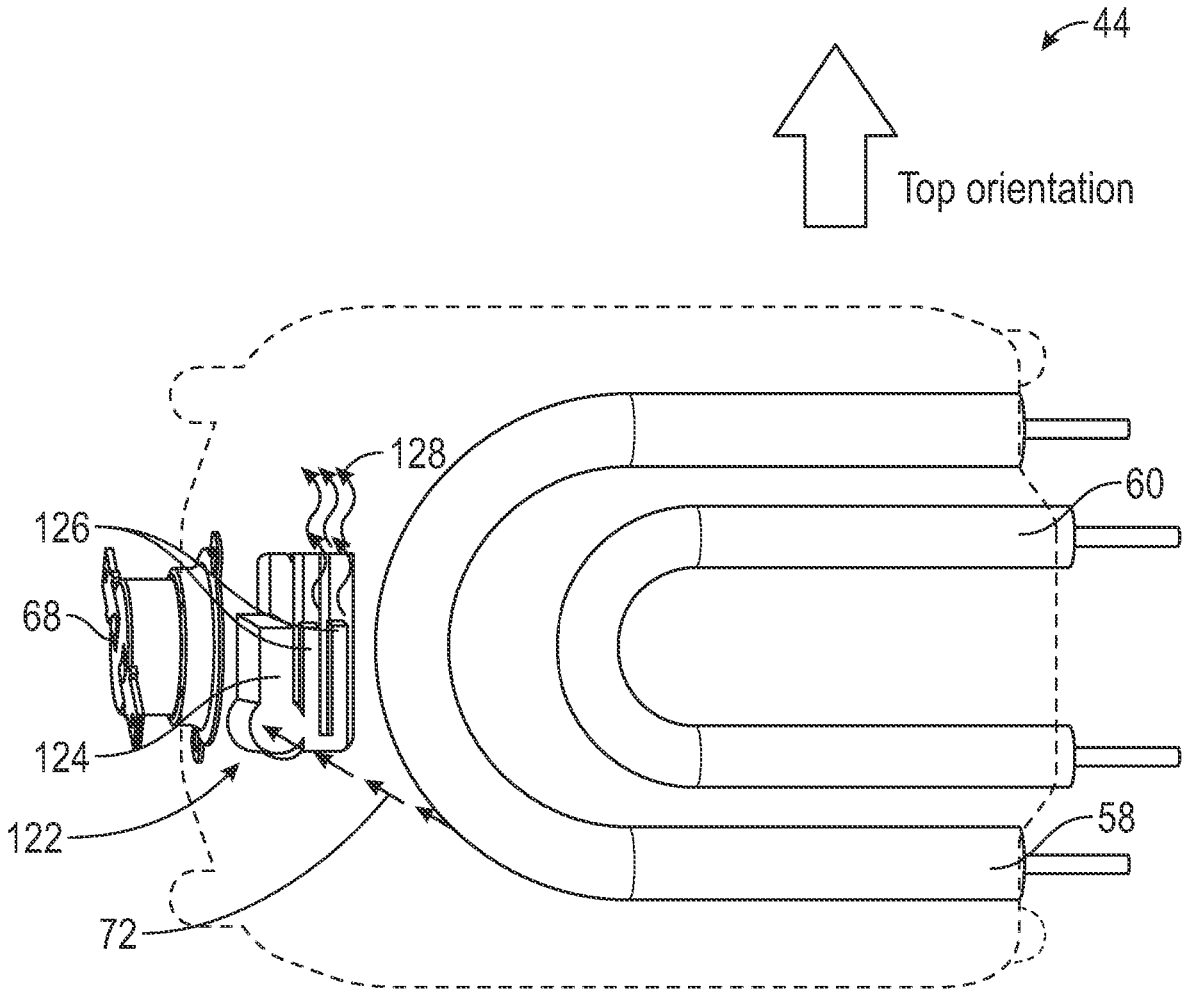
FIG. 30 is a simplified illustration of the steam generator assembly, illustrating a water bath configuration thereof.
Figure 31:
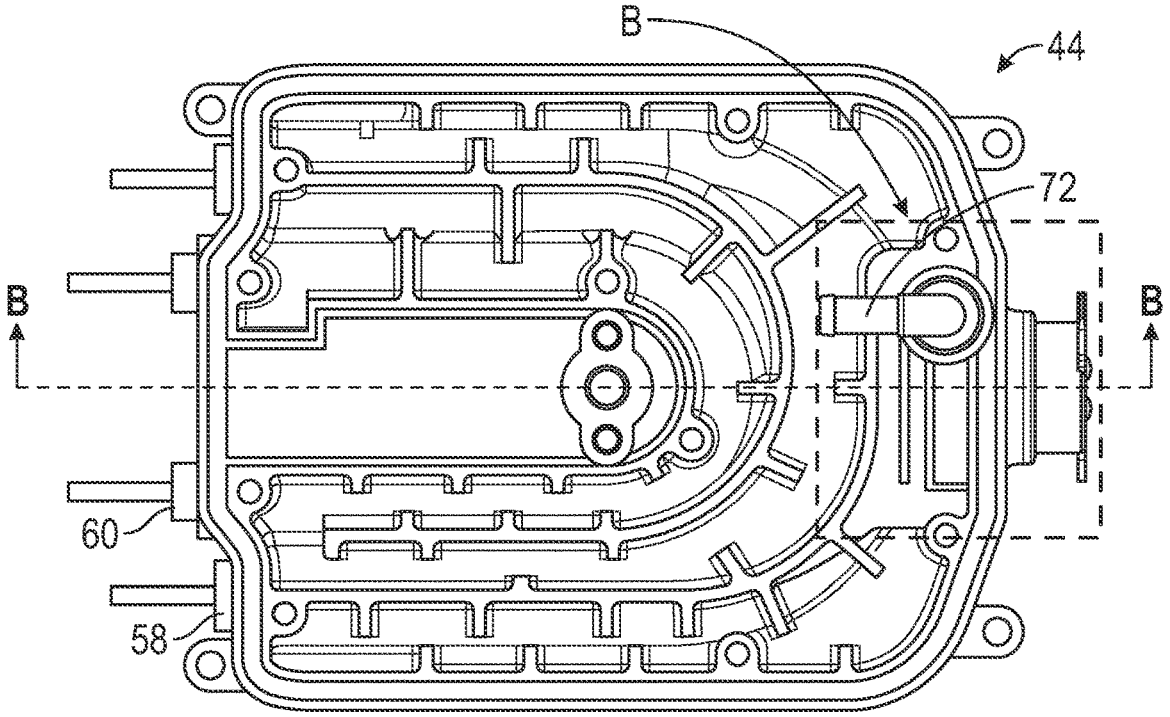
FIG. 31 is a rear elevational view of the steam generator assembly.

Turning now to FIG. 30, in an embodiment, the steam generator assembly 44 includes a water bath 122 in fluid communication with the water inlet tube 72, and which is configured to receive water therefrom, via pump 40. The water bath 122 is preferably positioned intermediate the primary heating element 58 and the thermostat 68. As illustrated in FIG. 30, the water bath 122 includes a main water bath 124 and two small capacity water baths 126 (although fewer or more than two small capacity water baths may be employed). Importantly, the small capacity water baths 126 are closer to the primary heating element 58 than the main water bath 124, and have a lesser volume capacity than the main water bath 124. The water baths 124, 126 are configured to simultaneously receive a supply of water from the inlet 72 upon actuation of the pump 40.

In operation, when the steam generator assembly 44 is activated from a cold condition, the primary heating element 58 is able to heat the water in the small capacity water baths 126 quickly (due to the lesser volume of water therein), thus resulting in a rapid generation of steam 128 (i.e., quicker response time). The generated steam 128 is then passed through the steam generator assembly 44 and out of the soleplate 46 in the manner hereinbefore described. This is an improvement on existing devices which typically need to wait until a preheat cycle is completed and for the thermostat to cut off prior to water being pumped to the steam generator (e.g., 20 seconds to 1 minute). The presence of the small capacity water baths 126 allows water to be pumped to the steam generator prior to the completion of preheating (i.e., prior to thermostat cut-off), allowing steam to be generated much earlier after start-up than is possible with existing devices.

Figure 32:
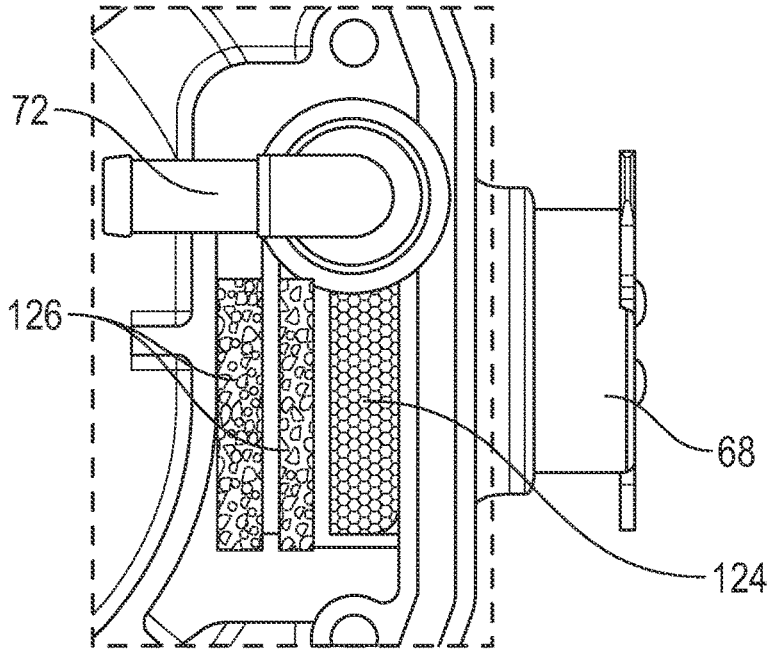
FIG. 32 is an enlarged view of area B of FIG. 31.
Figure 33:
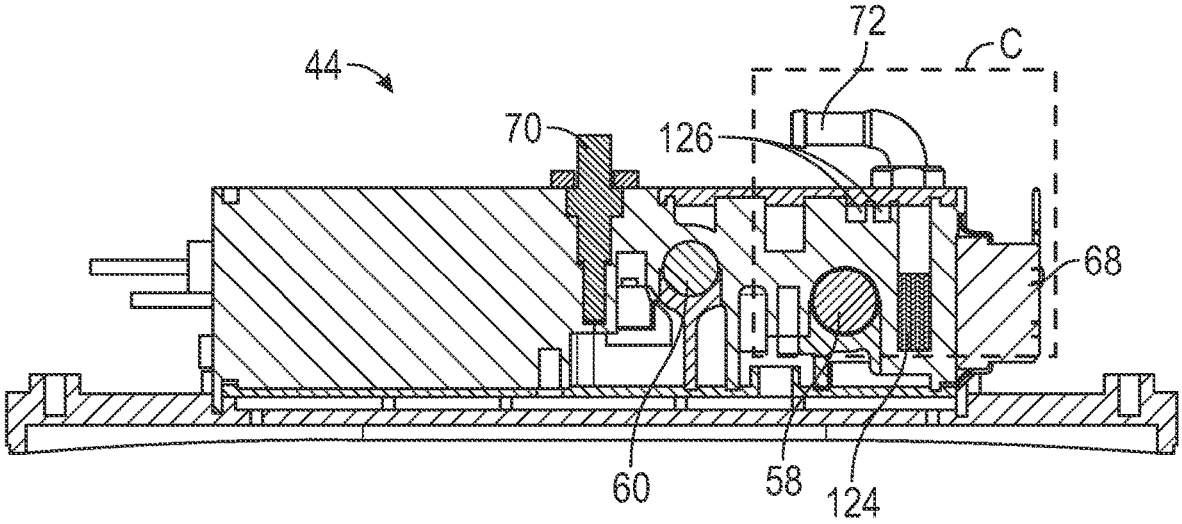
FIG. 33 is a cross-sectional view of the steam generator assembly, taken along line B-B of FIG. 31.
Figure 34:
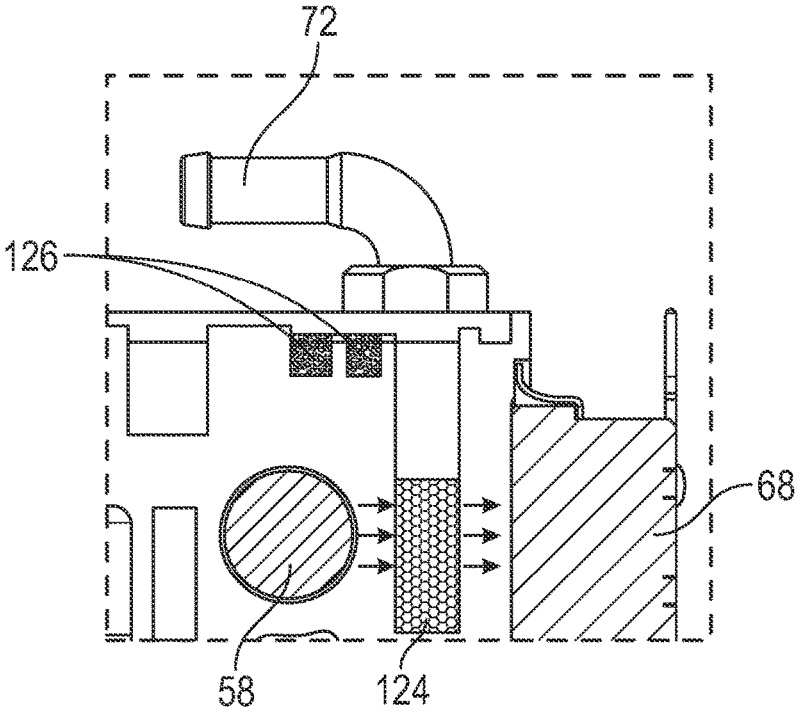
FIG. 34 is an enlarged view of area C of FIG. 33.

FIGS. 31-34 better illustrate the location and configuration of the water bath 122, including main water bath 124 and small capacity water baths 126. In an embodiment, as illustrated in FIGS. 32 and 34, the water baths 124, 126 may contain a foam metal (e.g., a cellular structure having a solid metal with gas-filled pores comprising a large portion of the volume). In an embodiment, the foam metal may be formed from copper or aluminum, although other conductive metals or materials may also be utilized without departing from the broader aspects of the invention. The use of a foam metal within one or both of the water baths 124, 126 provides a better response of the device to thermostat control, as described hereinafter. In particular, the mechanical thermostat 68 provides for temperature control of the steam generator assembly 44 by controlling the ON/OFF state of the primary heating element 58, the response of which affects the steam generating efficiency. During water pumping, the water bath(s) 124, 126 with the foam metal acts as a cooling buffer, keeping the thermostat 68 on to provide steady steam generation. When water pumping is ceased, the foam metal in the water bath(s) helps to transfer heat from the heating elements 58, 60 to the thermostat 68, thus cutting off the thermostat almost immediately after the ceasing of water pumping). Stated more generally, the use of the foam metal in the water bath(s) 124, 126 allows for improved control and better response of the device, as a whole. In particular, the use of the foam metal helps keep the thermostat 68 cool during initial pumping (so as to keep the thermostat on and not delay the heating of water) and, when pumping is shut off, the foam metal efficiently transfers heat to the thermostat to cut off the heater quickly.

Figure 35:
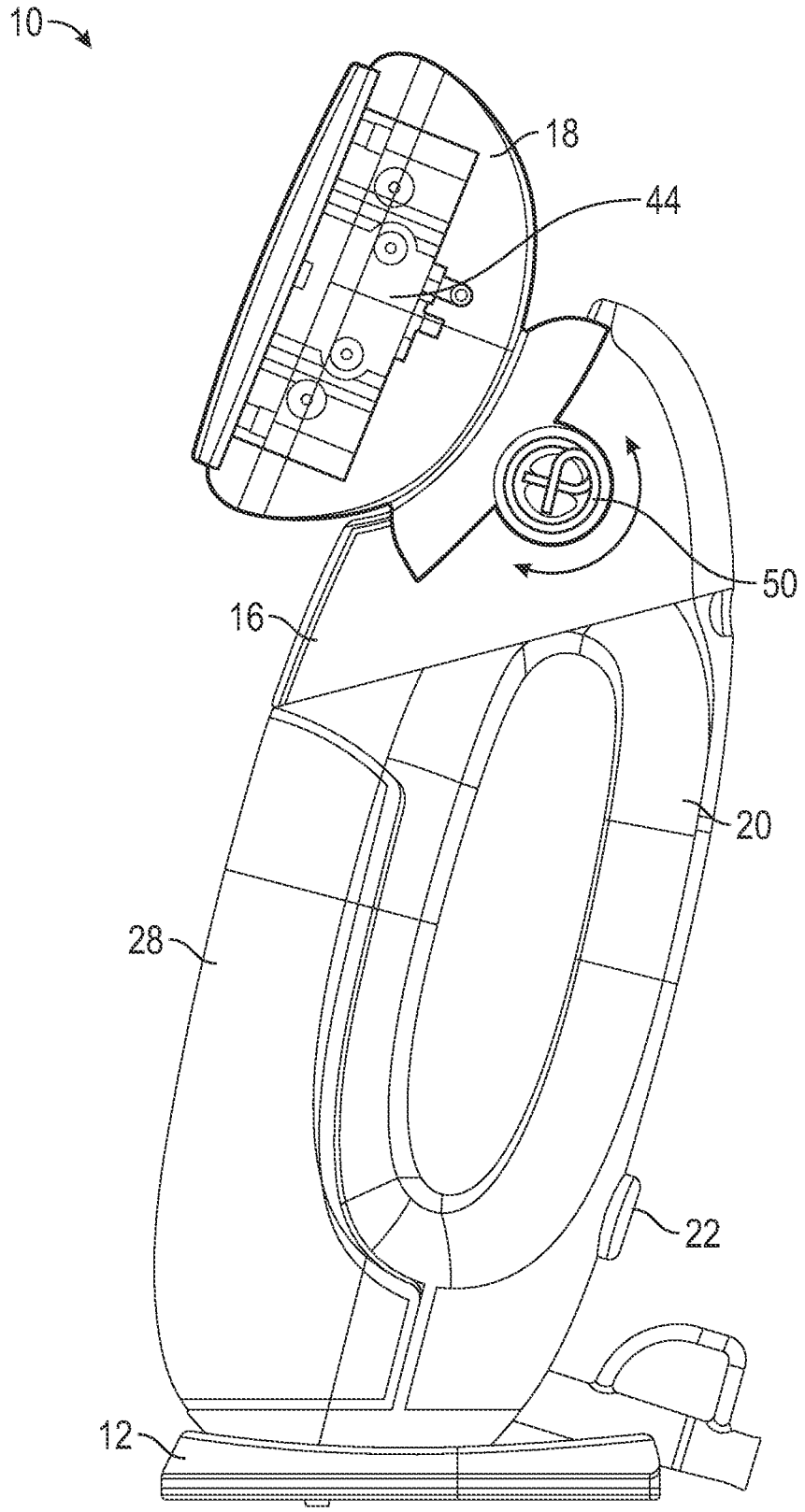
FIG. 35 is a side, partial cross-sectional view of the garment steaming device illustrating pivoting of the head.
Figure 36:
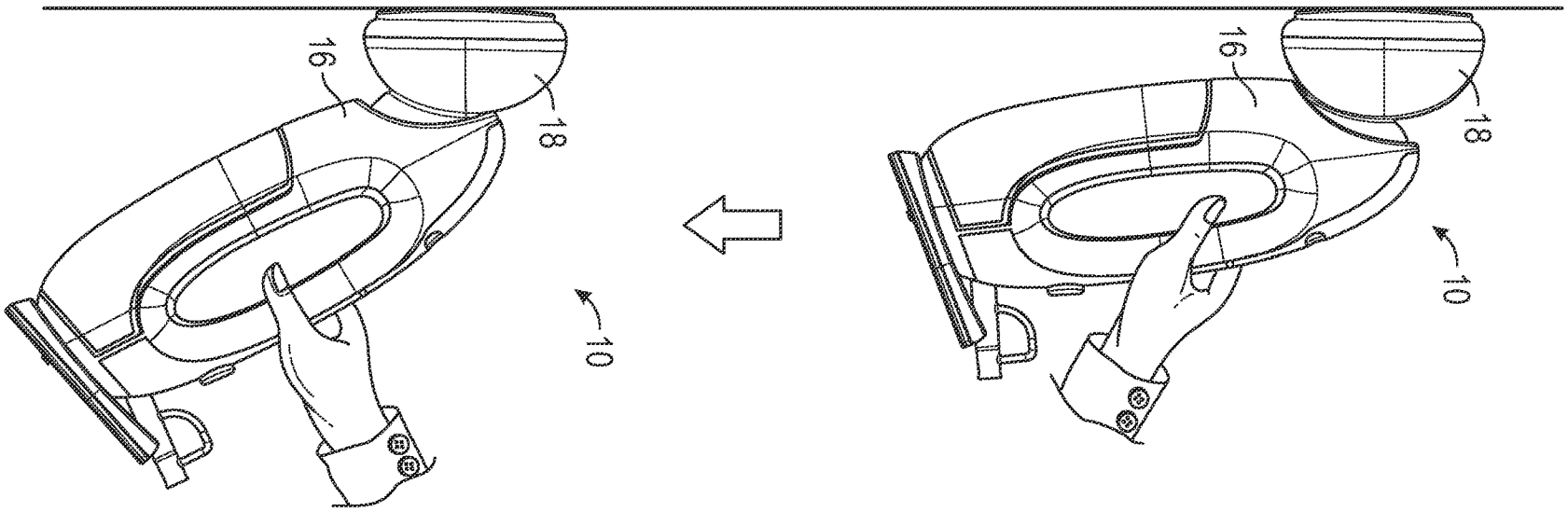
FIG. 36 is a side view illustrating use of the garment steaming device on a surface and showing the articulating head.

As disclosed above, and with reference to FIGS. 35 and 36, the head 18 of the garment steaming device 10 is pivotally connected to the housing 16 and is biased by coil spring 50. In use, the head 18 may be pressed against a surface, such as during a steaming or ironing operation, causing the head to pivot with respect to the housing 16. This articulating head 18 therefore provides an increased ease of use and level of user comfort heretofore not seen in the art. In addition, by locating the steam generator assembly 44 within the head 18, rather than the body/housing, the garment steaming device 10 of the present invention is able to deliver direct and steady steam even during angle adjustment/articulation of the head 18.

As disclosed above, in an embodiment, thermal/power control of the primary heating element 58 may be, for example, a mechanical thermostat, however, it is envisioned that an electronic control means such as a relay (for power control) with a NTC thermistor (for thermal/temperature detection) may also be utilized without departing from the broader aspects of the invention. Thermal/power control of the secondary heating element 60 may be carried out using control electronics such as, for example, a relay (for power control) with a NTC thermistor (for thermal/temperature detection), or a triac (for power control) with a NTC thermistor (for thermal/temperature detection), although other electronic control means may be utilized without departing from the broader aspects of the invention.

Importantly, therefore, the garment steaming device 10 of the present invention employs two types of power control, a thermostat for ON/OFF control of the primary heating element 58, and NTC thermal detection with triac/relay control power trimming of the secondary heating element 60. Accordingly, in an embodiment, a majority of the power control of the device 10 (e.g., greater than 60% of the total power) may be carried out using the thermostat 68, while a minority of the power control of the device 10 (e.g., less than 40% of the total power) may be carried out using the triac/relay control means 70. This hybrid power control is in contrast to existing devices which typically employ one type of power control or the other, but not both. Indeed, existing devices that use, solely, a mechanical thermostat, have an unpreventable power off cycle due to mechanical thermal detection tolerance; thus, power duty is only in the range of 50%-80%. In contrast, existing devices that use, solely, NTC thermal detection allow for more precise thermal control and high power duty (e.g., 70%-100%), but at a high cost, particularly at high power (i.e., 1500-3000 W).

The hybrid power control of the present invention, as disclosed above, allows the steam generator temperature (and the temperature of the steam produced) to be regulated by the triac/relay control 70 (relative lower power being enough) while the primary heating element 58 is continuously operated at a constant power (with no cut-off other than the first preheat cut-off). Accordingly, high power duty is maintained during operation, which provides high efficiency, steady steam generation. Importantly, therefore, steam temperature may be regulated almost solely using the triac/relay control without requiring thermostat ON/OFF cycling.

Figure 37:
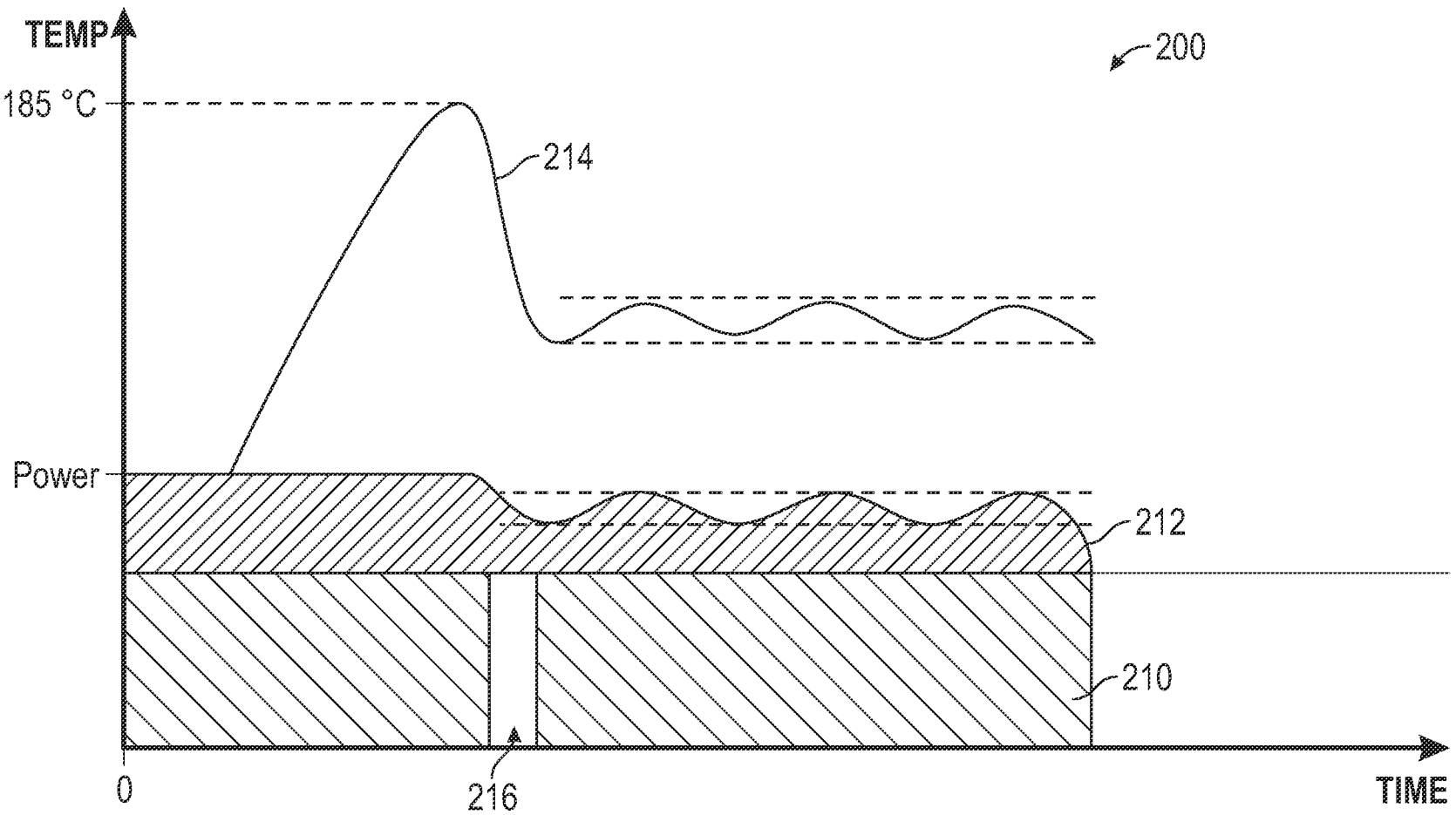
FIG. 37 is a graph illustrating a hybrid power control operation/function of the garment steaming device.

FIG. 37 is a graph 200 illustrating operation of the garment steaming device 10 using the hybrid power control described above. As illustrated therein, the primary heating element 58 may be operated at a constant power 210 of, for example, 1500 W under control from the thermostat 58. The secondary heating element 60 may be regulated at a power 212 between, for example, 150 W and 300 W, in order that the steam generator temperature 214 is kept between about 140° C. and about 160° C. Reference number 216 indicates the termination of a preheating cycle (i.e., thermostat cut-off).

Figure 38:
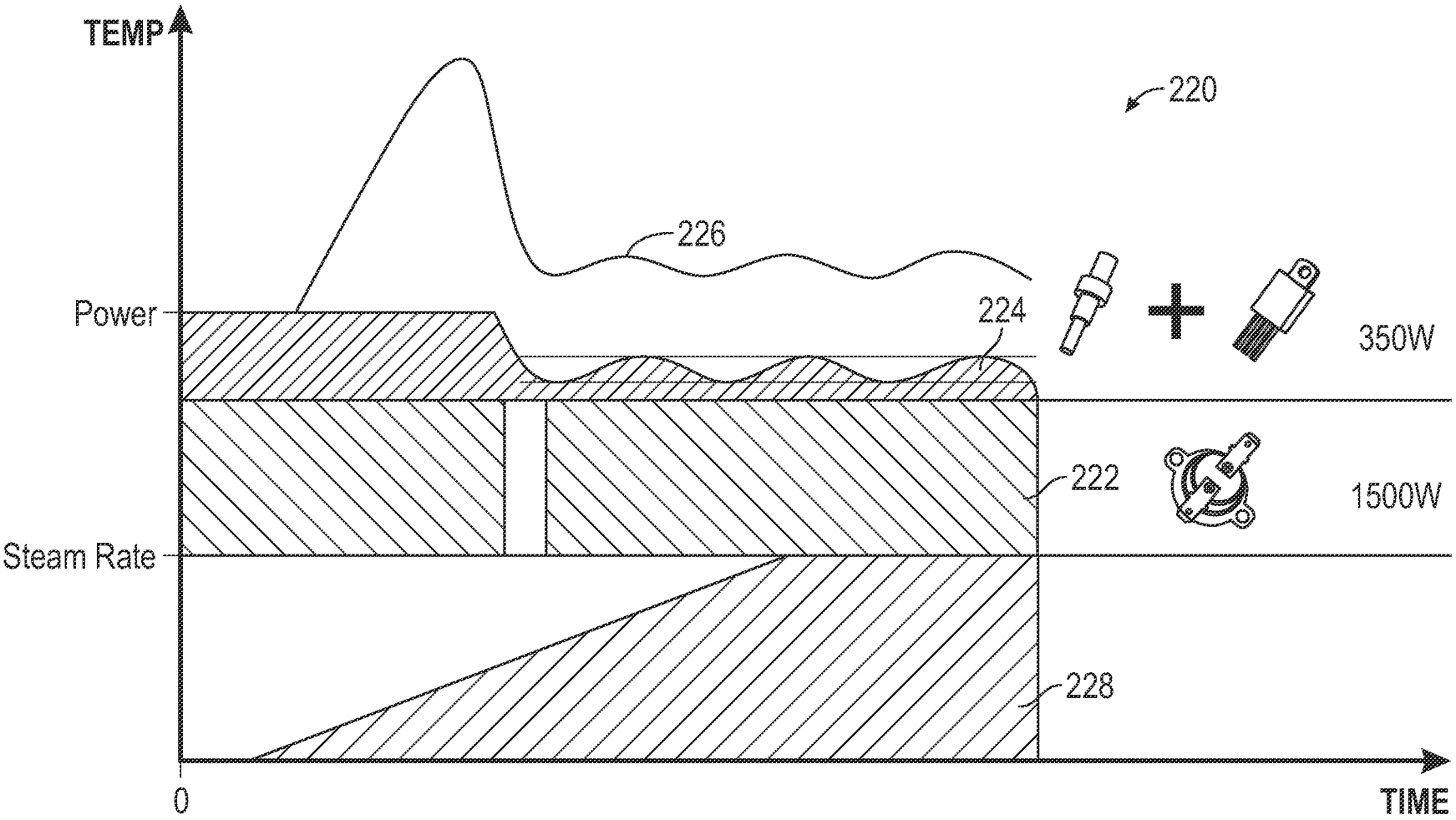
FIG. 38 is a graph illustrating low steam temperature operation of the garment steaming device and the hybrid power control thereof.

FIG. 38 is a graph 220 illustrating operation of the hybrid power control during a low steam temperature mode of the device 10, such as when steaming delicate fabrics such as silk. As illustrated therein, when low steam temperatures (e.g., between about 100° C. and about 130° C. are needed, the primary heating element 58 may be operated at a constant power 222 of, for example, 1500 W under control from the thermostat 58. The secondary heating element 60 may be regulated at a power 224 between, for example, 150 W and 250 W, in order that the steam generator temperature 226 is kept between about 100° C. and about 130° C. In addition, the rate of water supply to the steam generator 44 may be controlled by the pump 40 in order to control the steam rate 228. As shown in FIG. 38, for example, a relatively higher steam rate 228 may be applied for balancing the desired low steam temperature level.

Figure 39:
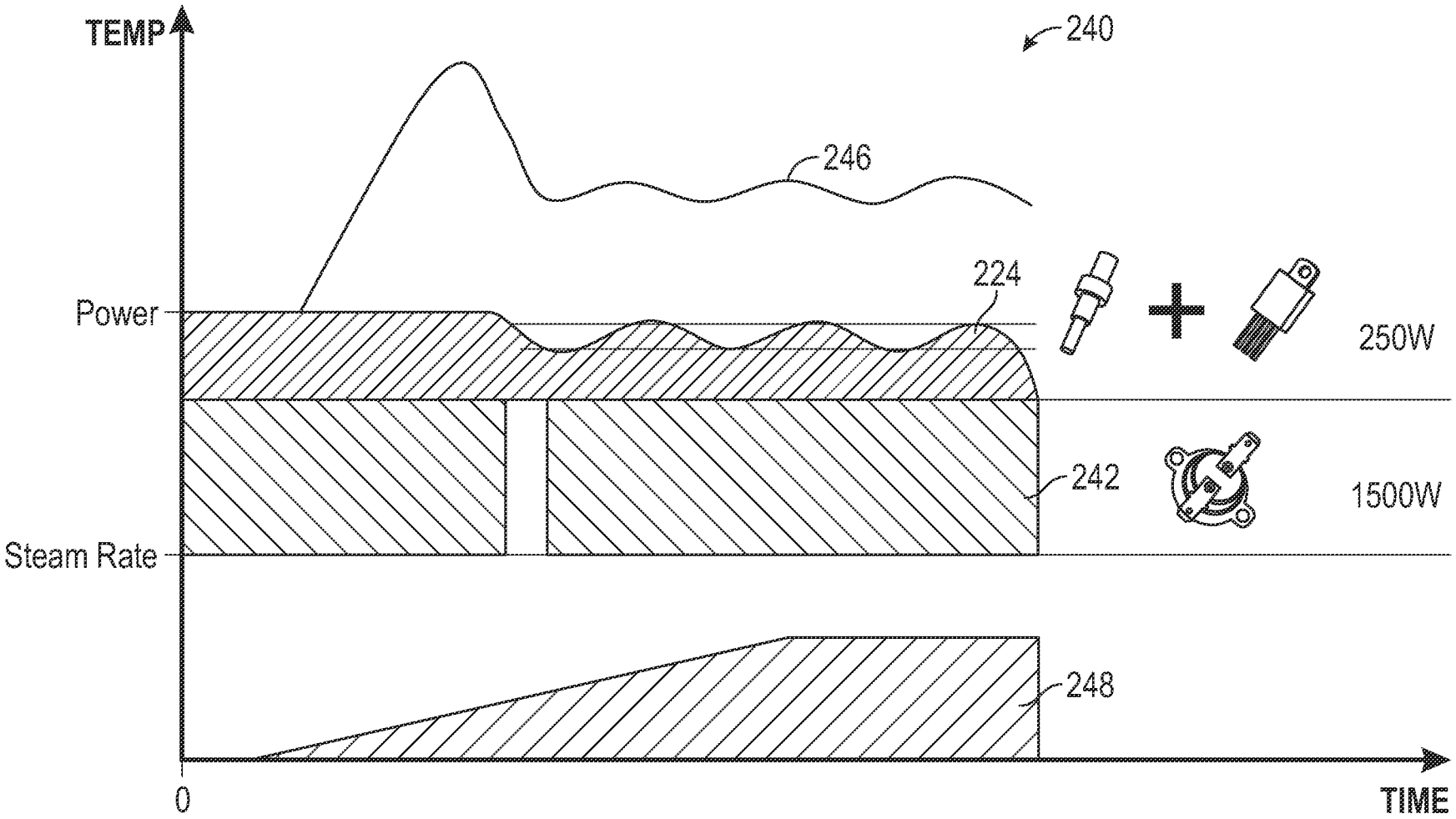
FIG. 39 is a graph illustrating high steam temperature operation of the garment steaming device and the hybrid power control thereof.

FIG. 39 is a graph 240 illustrating operation of the hybrid power control during a high steam temperature mode of the device 10, such as when steaming high temperature resistant fabrics such as cotton. As illustrated therein, when high steam temperatures (e.g., in excess of about 160° C. are needed, the primary heating element 58 may be operated at a constant power 242 of, for example, 1500 W under control from the thermostat 58. The secondary heating element 60 may be regulated at a power 244 between, for example, 250 W and 350 W, in order that the steam generator temperature 246 is kept between above about 160° C. In addition, the rate of water supply to the steam generator 44 may be controlled by the pump 40 in order to control the steam rate 248. As shown in FIG. 39, for example, a relatively lower steam rate 248 may be applied for balancing the desired high steam temperature level.

As discussed above, the ability to shorten response time (i.e., quickly generate steam on-demand without having to wait for a full preheating cycle to complete, and without water dripping) is a desirable aspect of any garment steamer. The present invention achieves these goals by employing a small capacity water bath 126 in which a small volume may be quickly heated to generate an initial burst of steam without having to run through an entire preheating cycle. This functionality is also aided by a soft-start programming control function executed by the control unit 38, whereby the pump 40 is actuated earlier during the preheating stage (without waiting for the preheating cycle to complete).

Figure 40:
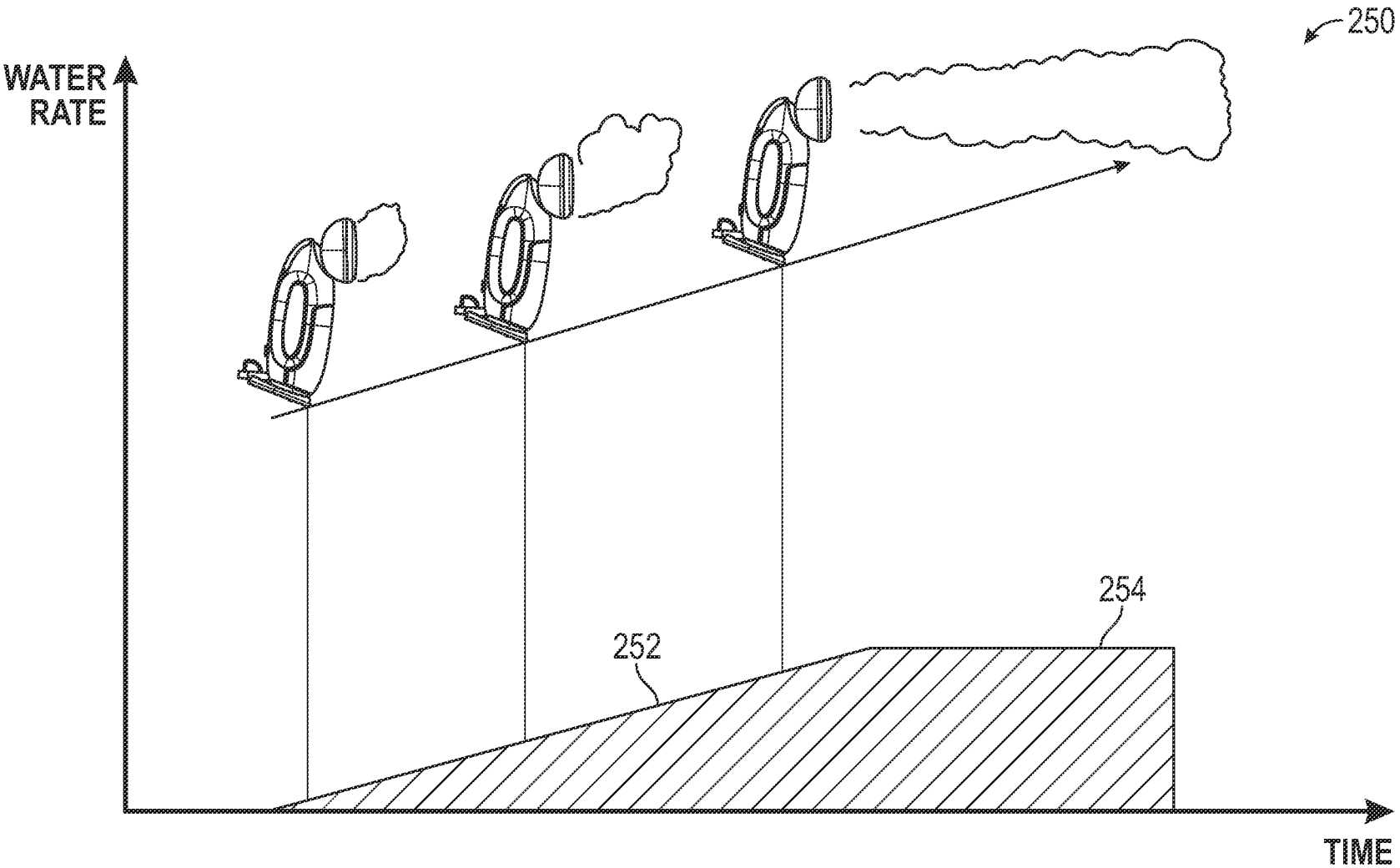
FIG. 40 is a graph illustrating a soft-start operation of the garment steaming device.

FIG. 40 is a graph 250 illustrating the soft-start control of the device 10. In operation, after or during preheating, the water pump rate can be gradually increased under control of the control unit 38, as illustrated at 252. Accordingly, steam may start at a relatively low rate, then increase gradually to a steady steam rate (achieved by a corresponding steady/constant water pump rate 254). This operation is in contrast to prior art devices which only have a single steam rate in each setting. Accordingly, prior art devices have difficulty in preventing water dripping when the device is operated from a cold start. With the present invention, however, this water dripping issue during a cold start may be minimized/prevented by providing a buffer period where the steam rate is kept relatively low, and then gradually increased to a constant steam rate once the primary heating element 58 is operational after preheating cut-off.

Figure 41:
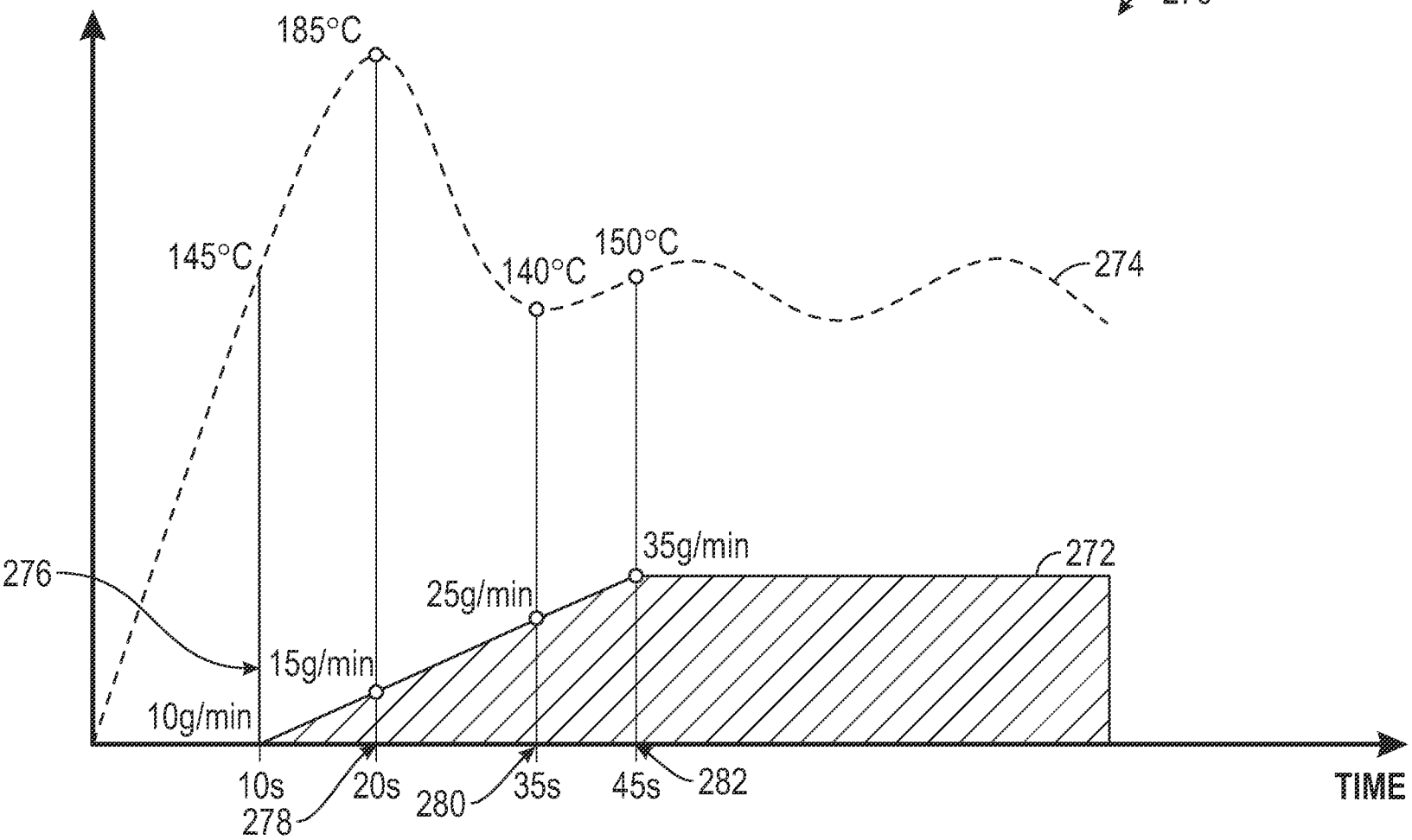
FIG. 41 is a graph illustrating the relationship between pump and heater control during a soft-start mode of operation of the garment steaming device.

Turning now to FIG. 41, a graph 270 illustrating the relationship between pump and heater control during soft-start is shown, where line 272 denotes the water flow rate to the steam generator, and line 274 denotes the steam generator temperature. As indicated above, the purpose of soft-start is to provide a quicker response (generate first steam burst rather quickly) from cold/cool start. As illustrated therein, during preheating, the control unit 38 may control the water pump 40 to pump water to the steam generator 44 from the reservoir 28 at a relatively low flow rate, which may generally correspond to the low steam generator temperature, and thus may yield a relatively low steam rate. The rate of the pump 40 is then ramped up gradually until power output becomes steady (e.g., normal power cycle) until the steam rate reaches a user setting. As shown therein, first steam generation is indicated by line 276, occurring at about 10 seconds. Preheating is complete at about 20 seconds, as indicated by reference numeral 278, at which time power to the primary heating element 58 is cut off. At about 35 seconds, the thermostat 58 powers ON the primary heating element 58, as indicated by reference numeral 280, and the steam rate reaches the user setting at about 45 seconds, as indicated by reference numeral 282.

In an embodiment, soft-start may also begin at or after the preheating cycle is finished. In such a mode, relative low steam rate ramp-up could also minimize water dripping when the primary heating element 58 is powered back on after a preheating cycle.

Figure 2:
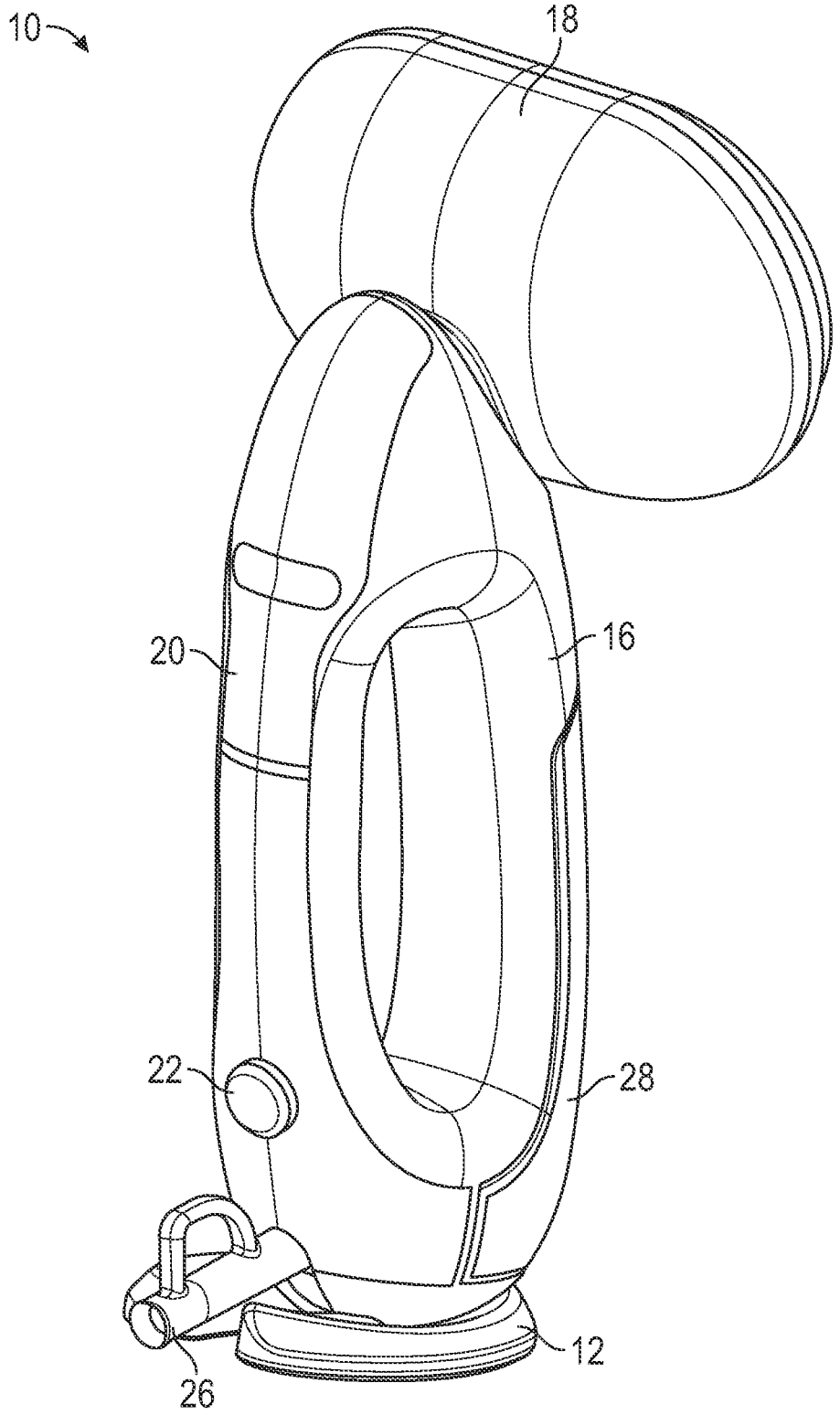
FIG. 2 is a rear, perspective view of the garment steaming device of FIG. 1.
Figure 3:
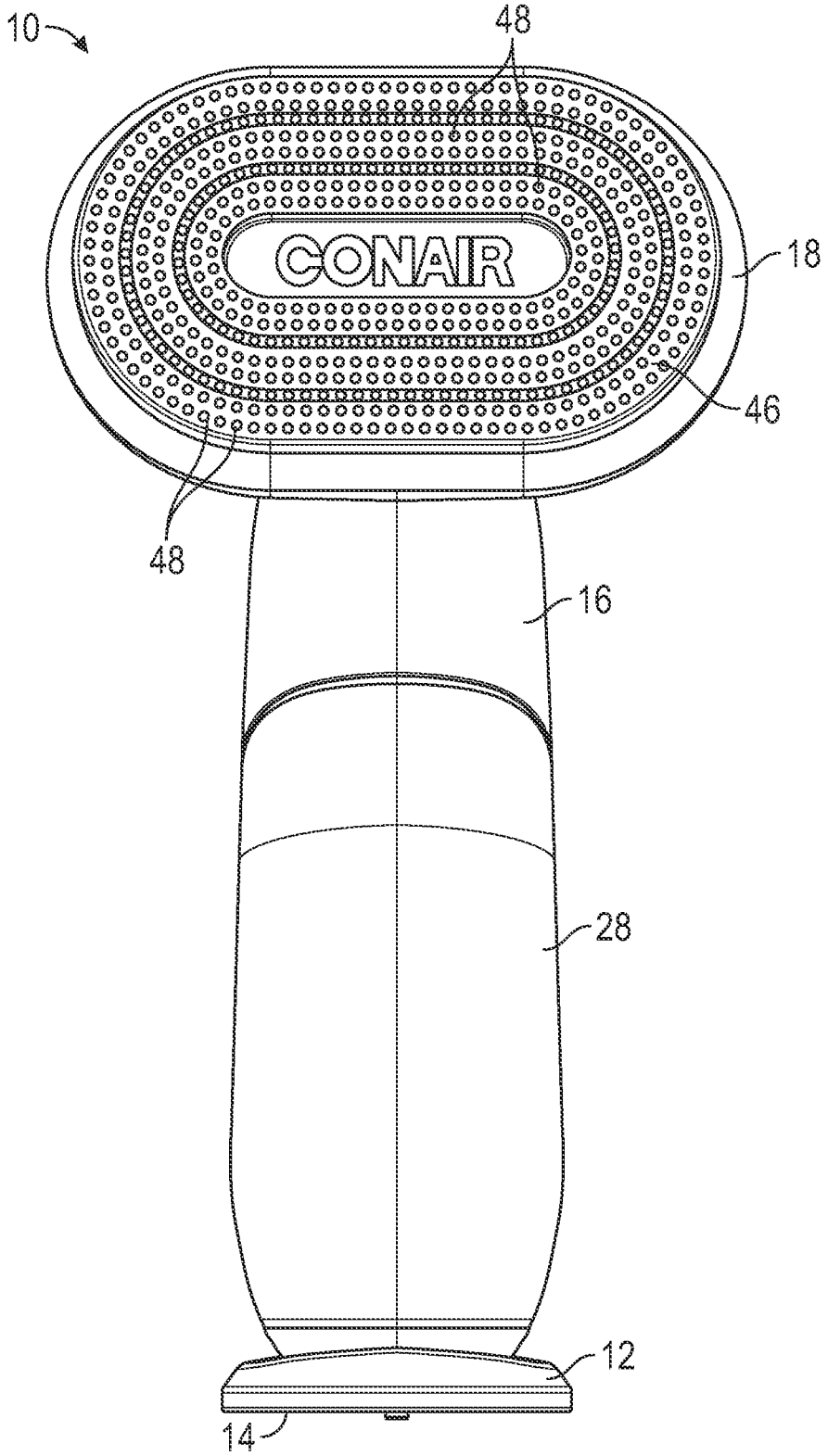
FIG. 3 is a front elevational view of the garment steaming device of FIG. 1.
Figure 43:
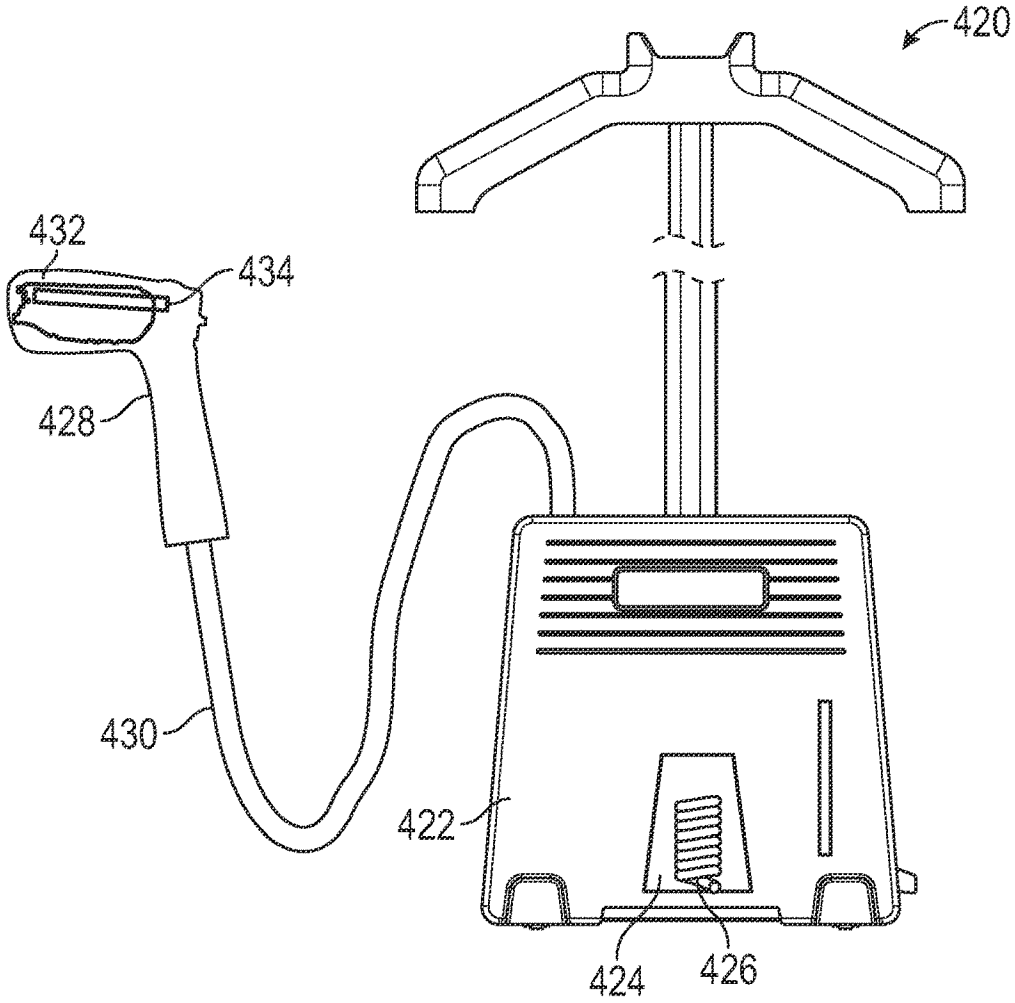
FIG. 43 is a simplified diagrammatic view of a garment steaming device according to another embodiment of the present invention.
Figure 42:
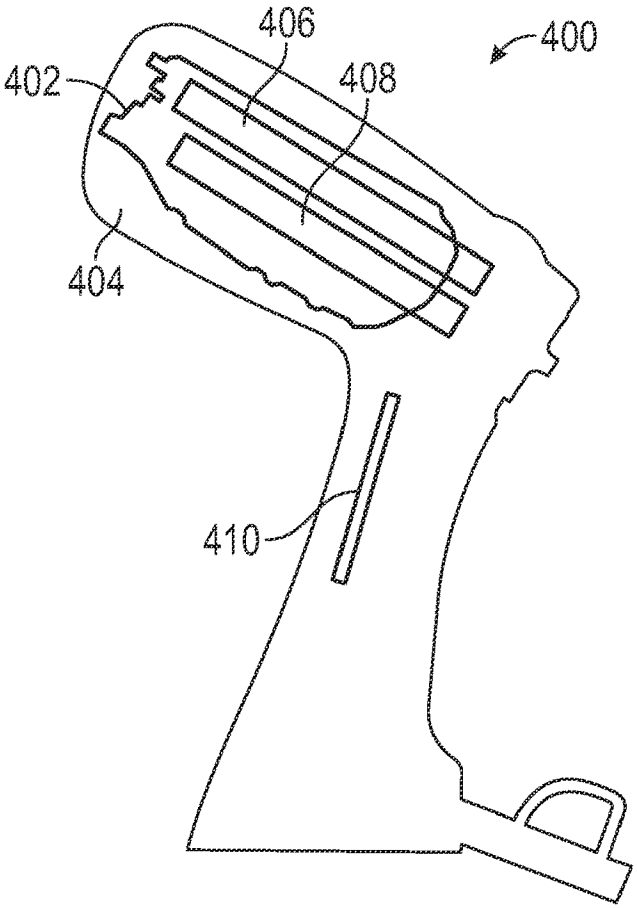
FIG. 42 is a simplified diagrammatic view of a garment steaming device according to another embodiment of the present invention.

Turning finally to FIGS. 42 and 43, garment steaming devices with alternative hybrid power system configurations according to other embodiments of the present invention are illustrated. As illustrated in FIG. 42, for example, a garment steaming device 400 may be configured as a handheld steamer having a steam generator 402 located in a head 404 of the device 400. The steam generator 400 may include first (primary) and second (secondary) heating elements 406, 408 similar to steam generator 10 disclosed above, and a control unit 410 for controlling operation of the device 400, including hybrid power control of the first and second heating elements 406, 408 in the manner described above. As illustrated in FIG. 2, the steam generator 402 may be oriented to lay flat within the head 404 rather than being positioned upright.

As illustrated in FIG. 43, an alternative garment steaming device 420 may be configured as an upright or tabletop garment steamer (i.e., full-size garment steamer) having a main housing or base 422 containing a primary steam generator 424 including a primary heating element 426. A handheld unit or nozzle 428 is connected to the base 422 via a flexible conduit 430, and includes a second steam generator 432 having a second heating element 434 within the handheld unit 428. The primary heating element 426 is configured to heat water to generate steam, which is then passed to the handheld unit 428 via the conduit 430 where it is further heated (or the temperature thereof more precisely controlled) by the second steam generator 432. The garment steaming device 420 also includes a control unit 410 for controlling operation of the device 420, including hybrid power control of the first and second heating elements 426, 432 in the manner described above.

As disclosed above, the garment steaming devices disclosed herein include a plurality of improvements over prior art devices in terms of ease of use, ergonomics, steam generating capability and responsiveness. In particular, the garment steaming devices disclosed herein employ a hybrid power control scheme to provide highly efficient, steady steam generation, and to allow for precise control of steam temperature. In addition, the garment steaming devices disclosed herein are programmed so as to provide a quick response upon start up, allowing for steam to be generated even during preheating without water dripping. In particular, this soft-start programming provides a low water pump rate during cool starting to eliminate any potential water dripping issues, and then gradually increases to a constant water pump rate to provide steady steam generation once preheating is complete. In connection with the above, the garment steaming devices of the present invention feature a small capacity water bath (in addition to the main water bath) positioned in close proximity to the heating element within the steam generator so that steam may be generated almost immediately upon start up, prior to the steam generator being fully heated to temperature required for steady operation (i.e., prior to preheating being completed). This level of responsiveness has heretofore not been possible in the art.

Moreover, the garment steaming devices utilize a foam metal material within one or more of the water baths, which helps increase thermostat response. Still further, the steam generator assembly and the multiple layers thereof provides a highly efficient and rapid steam generation capabilities, at high steam pressures. In connection with this, the soleplate covering the steam generator assembly is designed with a large surface area and a large number of steam outlets so as to provide full coverage steam at high pressures, which is evenly distributed throughout the soleplate. Moreover, by locating the steam generator within the articulating head, steady steam can be output directly even during angle adjustment of the head.

It is to be understood that the garment steaming devices disclosed herein may include the necessary electronics, software, memory, storage, databases, firmware, logic/state machines, microprocessors, communication links, displays or other visual or audio user interfaces, and any other input/output interfaces to perform the functions described herein and/or to achieve the results described herein. For example, the garment steaming devices may include at least one processor and system memory/data storage structures, which may include random access memory (RAM) and read-only memory (ROM). The at least one processor of the devices may include one or more conventional microprocessors and one or more supplementary co-processors such as math co-processors or the like. The data storage structures discussed herein may include an appropriate combination of magnetic, optical and/or semiconductor memory, and may include, for example, RAM, ROM, flash drive, an optical disc such as a compact disc and/or a hard disk or drive.

Additionally, a software application that adapts the controller to perform the methods disclosed herein may be read into a main memory of the at least one processor from a computer-readable medium. The term "computer-readable medium", as used herein, refers to any medium that provides or participates in providing instructions to the at least one processor of the device 10 (or any other processor of a device described herein) for execution. Such a medium may take many forms, including but not limited to, non-volatile media and volatile media. Non-volatile media include, for example, optical, magnetic, or opto-magnetic disks, such as memory. Volatile media include dynamic random access memory (DRAM), which typically constitutes the main memory. Common forms of computer-readable media include, for example, a floppy disk, a flexible disk, hard disk, magnetic tape, any other magnetic medium, a CD-ROM, DVD, any other optical medium, a RAM, a PROM, an EPROM or EEPROM (electronically erasable programmable read-only memory), a FLASH-EEPROM, any other memory chip or cartridge, or any other medium from which a computer can read.

While in embodiments, the execution of sequences of instructions in the software application causes at least one processor to perform the methods/processes described herein, hard-wired circuitry may be used in place of, or in combination with, software instructions for implementation of the methods/processes of the present invention. Therefore, embodiments of the present invention are not limited to any specific combination of hardware and/or software.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A garment steaming device, comprising:

a housing having a reservoir for containing liquid therein;

a head portion pivotably connected to the housing;

a steam generator contained within the head portion, the steam generator being in fluid communication with the reservoir for generating steam from the liquid contained in the reservoir; and a soleplate connected to the head portion, the soleplate having a plurality of outlets for distributing steam generated by the steam generator;

wherein the steam generator includes a cover having a plurality of apertures configured to distribute the steam to a layer between the cover and the soleplate;

wherein the number of the outlets in the soleplate is greater than the number of apertures in the cover;

wherein at least some of the outlets in the soleplate area aligned with at least some of the apertures in the cover to output direct, high-pressure steam; and wherein at least some other of the outlets in the soleplate are offset from the apertures in the cover to output steam at a lower pressure than the high-pressure steam.

2. A garment steaming device, comprising:

a housing having a reservoir for containing liquid therein;

a head portion pivotably connected to the housing; and a steam generator contained within the head portion, the steam generator being in fluid communication with the reservoir for generating steam from the liquid contained in the reservoir;

wherein the steam generator includes a first layer and a second layer and at least one heating element sandwiched between the first layer and the second layer; and wherein the first layer and the second layer define a steam flowpath that is configured such that steam flows back and forth between the first layer and the second layer before exiting the steam generator.

3. The garment steaming device of claim 2, wherein:

the first layer includes a first zone and a second zone;

wherein the second layer includes a third zone and a fourth zone; and wherein the first zone of the first layer is in fluid communication with the third zone of the second layer; and wherein the third zone of the second layer is in fluid communication with the second zone of the first layer;

wherein the second zone of the first layer is in fluid communication with the fourth zone of the second layer;

wherein the first zone, second zone, third zone and fourth zone define the steam flowpath such that steam flows from the first zone of the first layer into the third zone of the second layer, from the third zone of the second layer into the second zone of the first layer, and from the second zone of the first layer to the fourth zone of the second layer.

4. A garment steaming device, comprising:

a housing having a reservoir for containing liquid therein;

a base defining a planar bottom surface for supporting the housing;

a head portion pivotably connected to the housing and having a front face lying in a plane that intersects a plane defined by the planar bottom surface of the base;

a steam generator contained within the head portion, the steam generator being in fluid communication with the reservoir for generating steam from the liquid contained in the reservoir;

wherein the steam generator includes a primary heating element and a secondary heating element.

5. The garment steaming device of claim 4, further comprising:

a spring biasing mechanism configured to bias the head portion relative to the housing.

6. The garment steaming device of claim 4, further comprising:

a soleplate connected to the head portion, the soleplate having a plurality of outlets for distributing steam generated by the steam generator.

7. The garment steaming device of claim 6, wherein:

the steam generator includes a cover having a plurality of apertures configured to distribute the steam to a layer between the cover and the soleplate.

8. The garment steaming device of claim 7, wherein:

the number of the outlets in the soleplate is greater than the number of apertures in the cover.

9. The garment steaming device of claim 6, wherein:

the soleplate has more than 30 steam outlets.

10. The garment steaming device of claim 4, further comprising:

a pump configured to pump the liquid from the reservoir to the steam generator.

11. A garment steaming device, comprising:

a housing having a reservoir for containing liquid therein;

a head portion pivotably connected to the housing;

a steam generator contained within the head portion, the steam generator being in fluid communication with the reservoir for generating steam from the liquid contained in the reservoir, the steam generator including a primary heating element and a secondary heating element; and a control unit configured to regulate a steam temperature generated by the steam generator by operating the primary heating element at a constant power and varying a power level of the secondary heating element.

12. A garment steaming device, comprising:

a housing having a reservoir for containing liquid therein;

a head portion pivotably connected to the housing;

a steam generator contained within the head portion, the steam generator being in fluid communication with the reservoir for generating steam from the liquid contained in the reservoir, the steam generator including a primary heating element and a secondary heating element;

a first control device for controlling the primary heating element; and a second control device for controlling the secondary heating element.

13. The garment steaming device of claim 12, wherein:

the first control device is a mechanical thermostat; and the second control device is a NTC thermistor with a relay or triac.

14. A garment steaming device, comprising:

a housing having a reservoir for containing liquid therein;

a head portion pivotably connected to the housing; and a steam generator contained within the head portion, the steam generator being in fluid communication with the reservoir for generating steam from the liquid contained in the reservoir;

wherein the steam generator includes a main water bath and a secondary water bath, the main water bath and the secondary water bath being in fluid communication with the reservoir for receiving liquid therefrom;

wherein the secondary water bath has a capacity that is less than a capacity of the main water bath to facilitate rapid generation of steam.

15. The garment steaming device of claim 14, wherein:

the secondary water bath is positioned in close association with a heating element of the steam generator.

16. The garment steaming device of claim 15, wherein:

at least one of the main water bath and the second water bath includes a foam metal material.

17. A garment steaming device, comprising:

a housing having a reservoir for containing liquid therein;

a head portion pivotably connected to the housing;

a steam generator contained within the head portion, the steam generator being in fluid communication with the reservoir for generating steam from the liquid contained in the reservoir;

a pump configured to pump the liquid from the reservoir to the steam generator; and a control unit configured to control the pumping rate of the pump;

wherein the control unit is configured to control the pump to provide a first flow rate of fluid to the steam generator during a preheating mode of operation of the garment steaming device, and to control the pump to provide a second flow rate of fluid to the steam generator after the preheating mode of operation is complete;

wherein the first flow rate is less than the second flow rate.

18. The garment steaming device of claim 17, wherein:

the control unit is configured to control the pump to gradually increase the flow rate of fluid to the steam generator from the first flow rate to the second flow rate.

19. A garment steaming device, comprising:

a housing having a reservoir for containing liquid therein;

a head portion pivotably connected to the housing;

a steam generator contained within the head portion, the steam generator being in fluid communication with the reservoir for generating steam from the liquid contained in the reservoir, the steam generator including a primary heating element and a secondary heating element;

a pump configured to pump the liquid from the reservoir to the steam generator; and a control unit configured to control the pumping rate of the pump, a power level of the primary heating element and a power level of the secondary heating element;

wherein the control unit is configured to regulate a steam temperature generated by the steam generator by operating the primary heating element at a constant power and varying a power level of the secondary heating element, and by varying a pumping rate of the pump.

* * * * *